US009248651B2

(12) United States Patent
Ueda et al.

(10) Patent No.: US 9,248,651 B2
(45) Date of Patent: Feb. 2, 2016

(54) LIQUID DISCHARGE APPARATUS

(71) Applicant: Brother Kogyo Kabushiki Kaisha, Nagoya-shi, Aichi-ken (JP)

(72) Inventors: Toshiro Ueda, Nagoya (JP); Masayuki Takata, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/630,925

(22) Filed: Feb. 25, 2015

(65) Prior Publication Data

US 2015/0239250 A1 Aug. 27, 2015

(30) Foreign Application Priority Data

Feb. 25, 2014 (JP) ..... 2014-033821

(51) Int. Cl.
*B41J 2/165* (2006.01)

(52) U.S. Cl.
CPC ..... *B41J 2/16505* (2013.01)

(58) Field of Classification Search
None
See application file for complete search history.

(56) References Cited

U.S. PATENT DOCUMENTS

2007/0165062 A1* 7/2007 Usui ..... B41J 2/16508 347/29
2012/0062647 A1 3/2012 Nemoto
2013/0033542 A1 2/2013 Nakazawa

FOREIGN PATENT DOCUMENTS

JP 4882501 2/2012
JP 2012/061680 3/2012
JP 2013/035175 2/2013

* cited by examiner

*Primary Examiner* — Geoffrey Mruk
*Assistant Examiner* — Bradley Thies
(74) *Attorney, Agent, or Firm* — Frommer Lawrence & Haug LLP

(57) ABSTRACT

There is provided a liquid discharge apparatus including a liquid discharge head, a cap, a movement mechanism configured to move one of the liquid discharge head and the cap to selectively take a first and a second contact state, and a separated state. The cap includes a first and a second cap portion configured to respectively cover a plurality of first and second nozzles, and a communicative portion for the first cap portion to communicate with the second cap portion. The communicative portion includes a part of a first surrounding projection formed lower in the height than the other portion of a first surrounding projection of the first cap portion except the communicative portion.

9 Claims, 14 Drawing Sheets

LIQUID DISCHARGE APPARATUS

CROSS REFERENCE TO RELATED APPLICATION

The present application claims priority from Japanese Patent Application No. 2014-033821, filed on Feb. 25, 2014, the disclosure of which is incorporated herein by reference in its entirety.

BACKGROUND

1. Field of the Invention

The present invention relates to liquid discharge apparatuses.

2. Description of the Related Art

There are known ink jet printers including a cap member adapted to cover a plurality of nozzles formed in an ink jet surface by contact with the ink jet surface, and a suction pump connected with the cap member via a switching unit. The plurality of nozzles include a plurality of nozzles for black ink and a plurality of nozzles for color inks. The cap member has a first cap portion to cover the plurality of nozzles for black ink, and a second cap portion to cover the plurality of nozzles for color inks. These first and second cap portions are connected respectively with the switching unit via suction ports. The switching unit causes the suction pump to communicate with any one of the first and second cap portions. In this configuration, when the cap member comes to contact with the ink jet surface so as to cover the plurality of nozzles, the suction pump is driven, and the switching unit causes the suction pump to communicate individually with each of the cap portions; thereby, it is possible to purge the inks respectively from the plurality of nozzles for the black ink and from the plurality of nozzles for the color inks.

SUMMARY

With such an ink jet printer described above, it is not possible to simultaneously discharge the inks from the nozzles for the black ink and from the nozzles for the color inks covered by the respective cap portions. In this manner, if it is not possible to simultaneously discharge the inks from the plurality of nozzles for the black and color inks, then even when the inks are discharged from all the nozzles, it becomes necessary each time to purge the inks respectively from the nozzles for the black ink and from the nozzles for the color inks, thereby needing a longer time for the purge. For example, in order to simultaneously discharge the inks from all the nozzles, it is conceivable for the switching unit to cause simultaneous communications between the respective cap portions and the suction pump. However, this will lead to a very complicated configuration of the switching unit.

Accordingly, it is an object of the present teaching to provide a liquid discharge apparatus capable of switching connective ports in a suction mechanism with a simple configuration.

According to an aspect of the present teaching, there is provided a liquid discharge apparatus configured to discharge liquid, including:

a liquid discharge head having a discharge-surface in which a plurality of nozzles is formed;

a cap including an inner bottom surface facing the discharge-surface and, in contact with the discharge-surface, to cover the plurality of nozzles;

a movement mechanism configured to move at least one of the liquid discharge head and the cap to selectively take a first contact state for the cap to contact with the discharge-surface, a second contact state for the inner bottom surface of the cap to contact with the discharge-surface and to come closer to the discharge-surface than in the first contact state, and a separated state for the cap to separate from the discharge-surface; and a suction mechanism, wherein the plurality of nozzles include:

a plurality of first nozzles arrayed in one direction, and a plurality of second nozzles arrayed in the one direction and arranged in different positions from the plurality of first nozzles in an orthogonal direction orthogonal to the one direction;

wherein the cap includes:

a first cap portion configured to cover the plurality of first nozzles, the first cap portion including a first inner bottom surface facing the discharge-surface, a first surrounding projection being elastically deformable and projecting from the first inner bottom surface toward the discharge-surface, and a first connective port to be connected with the suction mechanism;

a second cap portion configured to cover the plurality of second nozzles, the second cap portion including a second inner bottom surface facing the discharge-surface, a second surrounding projection being elastically deformable and projecting from the second inner bottom surface toward the discharge-surface, and a second connective port to be connected with the suction mechanism; and a communicative portion configured to communicate the first cap portion and the second cap portion, wherein the communicative portion includes a part of the first surrounding projection of the first cap portion which is formed lower in the height from the inner bottom surface than the other portions of the first surrounding projections except the communicative portion, wherein the first cap portion is configured to seal up a first space between the first cap portion and the discharge-surface by causing the whole first surrounding projection to contact with the discharge-surface in the second contact state, wherein the second cap portion is configured to seal up a second space between the second cap portion and the discharge-surface by causing the whole second surrounding projection to contact with the discharge-surface in the second contact state, and wherein the part of the first surrounding projection of the communicative portion is separated from the discharge-surface in the first contact state, and contacts with the discharge-surface in the second contact state, and wherein the first and second cap portions and the communicative portions are configured to seal up the first and second spaces such that the first space is communicated with the second space via the communicative portion, in the first contact state.

According to the liquid discharge apparatus of the present teaching, in the first contact state, it is possible to cause the first space and the second space to communicate with each other via the communicative portion, whereas in the second contact state, it is possible to seal up the first and second spaces individually with the first cap portion and the second cap portion. Therefore, in the first contact state, with the suction mechanism sucking from any of the first connective port and the second connective port, the communicative first and second spaces come under negative pressure whereby it is possible to discharge the liquid simultaneously from all the nozzles. In the second contact state, with the suction mechanism sucking from any of the first and second connective ports, it is possible to discharge the liquid individually from the plurality of first nozzles and the plurality of second nozzles. In this manner, it is possible to switch for individually or simultaneously discharging the liquid from the plurality of first nozzles and the plurality of second nozzles, by changing the contact state between the discharge-surface and the cap. Therefore, it is possible for the suction mechanism to switch the connective ports with a simple configuration.

BRIEF DESCRIPTION OF THE DRAWINGS

FIGS. 8A to 8C show operational conditions of the cap in a cross section along the line VIII-VIII of FIG. 7, wherein FIG. 8A is a condition diagram with the cap in a separated state, FIG. 8B is a condition diagram with the cap in a first contact state, and FIG. 8C is a condition diagram with the cap in a second contact state;

FIGS. 11A to 11D show conditions of the maintenance operation for the periodic purge, wherein FIG. 11A shows a condition of a periodic suction purge process for color inks, FIG. 11B shows a condition of a first discharge process for the color inks, FIG. 11C shows a condition of a second discharge process for the color inks, and FIG. 11D shows a condition of a third discharge process for the color inks;

FIGS. 13A to 13D show conditions of the maintenance operation for the manual purge, wherein FIG. 13A shows a condition of a first suction purge process for the color inks, FIG. 13B shows a condition of a second suction purge process for the color inks, FIG. 13C shows a condition of a first discharge process for the color inks, and FIG. 13D shows a condition of a second discharge process for the color inks.

DESCRIPTION OF THE EMBODIMENT

Hereinbelow, referring to the accompanying drawings, an embodiment of the present teaching will be explained.

<Schematic Configuration of a Printer>

Figure 1:
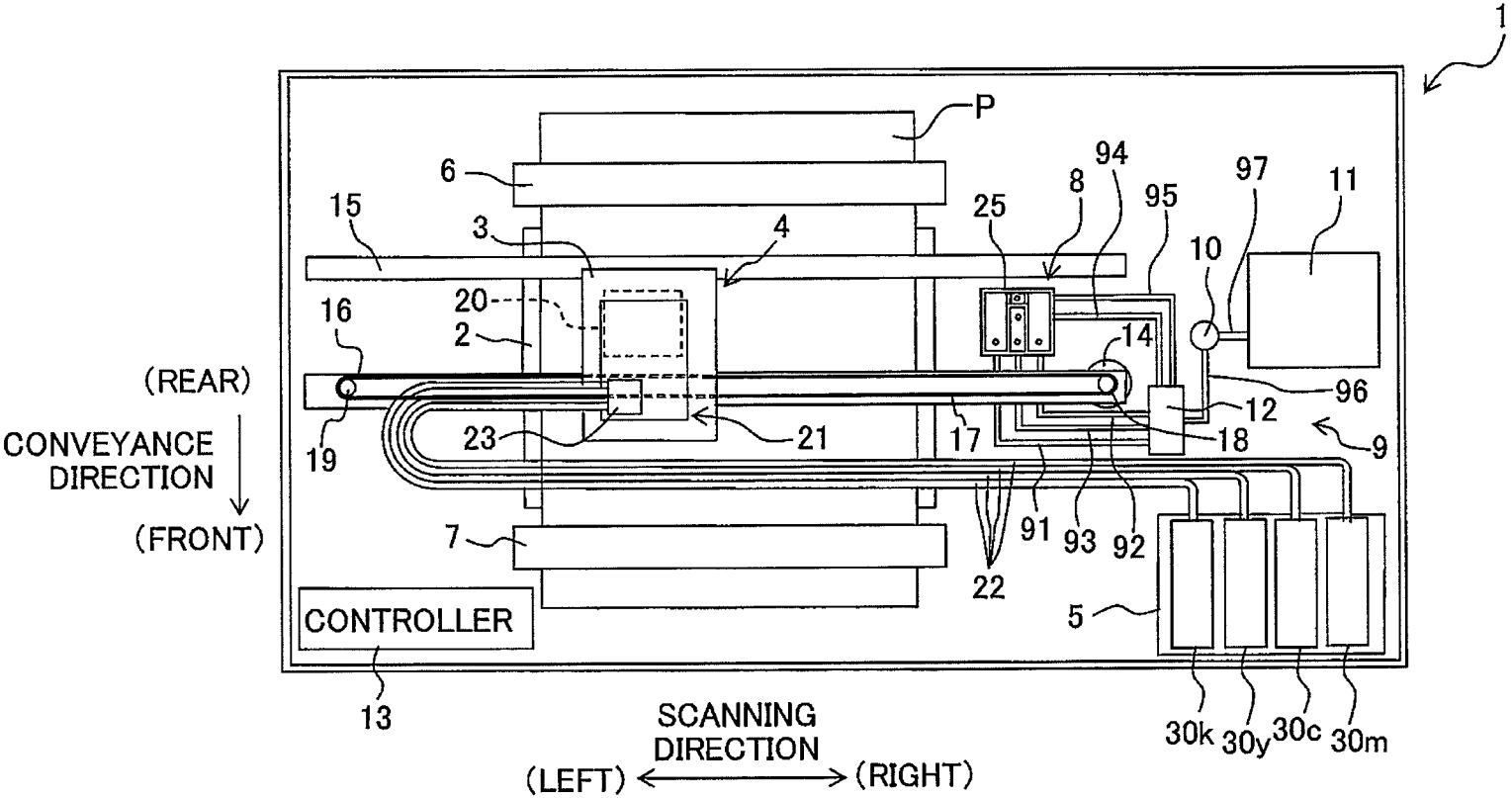
FIG. 1 is a schematic plan view of a printer according to an embodiment of the present teaching.

As depicted in FIG. 1, a printer 1 (the liquid discharge apparatus) includes a platen 2, a carriage 3, an ink jet head 4 (the liquid jet head), a holder 5, a paper feed roller 6, a paper discharge roller 7, a cap device 8, a suction device 9 (the suction mechanism), a control device 13 (the controller), etc. Further, hereinbelow, the near side of the page of FIG. 1 is defined as "upper side" or "upside" of the printer 1, while the far side of the page is defined as "lower side" or "downside" of the printer 1. Further, the front-rear direction and the left-right direction depicted in FIG. 1 are defined as "front-rear direction" and "left-right direction" of the printer 1, respectively. The following explanation will be made while appropriately using each directional term of the front-rear, left-right, and up-down.

On the upper surface of the platen 2, there is placed a sheet of paper P which is a recording medium. Further, above the platen 2, two guide rails 15 and 16 are provided to extend parallel to the left-right direction of FIG. 1 (also referred to as a scanning direction).

The carriage 3 is fitted on the two guide rails 15 and 16, and is movable in the scanning direction along the two guide rails 15 and 16 in a region facing the platen 2. Further, a drive belt 17 is fitted to the carriage 3. The drive belt 17 is an endless belt fastened on and around two pulleys 18 and 19. The pulley 18 is linked to a carriage drive motor 14. Whenever the carriage drive motor 14 drives the pulley 18 to rotate, the drive belt 17 is caused to operate, thereby reciprocatingly moving the carriage 3 in the scanning direction.

The ink jet head 4 is mounted on the carriage 3. The ink jet head 4 has a head portion 20 and an ink supply portion 21. In the holder 5, there are installed four ink cartridges 30 which are removable and respectively retain four types of inks (black, yellow, cyan, and magenta). Further, in the following explanation, among the components of the printer 1, to those corresponding respectively to the inks of black (K), yellow (Y), cyan (C) and magenta (M), letters will be assigned respectively after the reference numerals denoting the components so as to facilitate the knowledge of corresponding to which of the inks such that the letter "k" is assigned to indicate black, the letter "y" to indicate yellow, the letter "c" to indicate cyan, and the letter "m" to indicate magenta. For instance, the ink cartridge 30*k* refers to the ink cartridge 30 retaining the black ink. Further, the term "color inks" may sometimes be used to collectively refer to the three color inks of yellow, cyan and magenta, excluding the black ink.

The head portion 20 has four types of nozzles 47 (see FIG. 4) formed in its lower surface to respectively jet the four types of inks. That is, the lower surface of the head portion 20 is a jet surface 20*a* (see FIG. 3) for the plurality of nozzles 47 to jet the inks. A detailed description will be made later on a specific channel structure and the like of the head portion 20.

The ink supply portion 21 is arranged above the head portion 20 to supply the four types of inks to the head portion 20. The ink supply portion 21 has a sub-tank 31, and four tubes 22 connected to the holder 5 are connected to the sub-tank 31 via a tube joint 23. Further, the four tubes 22 may be connected respectively to the sub-tank 31 without using the tube joint 23.

The paper feed roller 6 and the paper discharge roller 7 are synchronized with each other and driven to rotate by an undepicted motor. The paper feed roller 6 and the paper discharge roller 7 cooperate to transport the paper P positioned on the platen 2 in a conveyance direction (frontward) indicated in FIG. 1. Then, the printer 1 prints desired images and the like on the paper P by jetting the inks from the plurality of nozzles 47 of the head portion 20 while letting the paper feed roller 6 and paper discharge roller 7 transport the paper P in the conveyance direction and moving the ink jet head 4 in the scanning direction.

The cap device 8 is arranged to locate on one side (the right side) of the platen 2 according to the scanning direction. The cap device 8 has a cap 25 and a cap drive mechanism 26. If the carriage 3 moves to the right side of the platen 2, then the cap 25 comes to face the jet surface 20*a* of the head portion 20. In this state, the cap drive mechanism 26 raises the cap 25 such that the cap 25 covers all the nozzles 47 of the head portion 20. A specific configuration of the cap device 8 will be described later.

The suction device 9 has a suction pump 10, a waste tank 11, and a switching portion 12. The cap 25 is connected to the suction pump 10 via the switching portion 12. With the cap 25 covering the plurality of nozzles 47 of the head portion 20, the suction pump 10 depressurizes the inside of the cap 25 so as to suck and discharge the inks from the plurality of nozzles 47 respectively (suction purge). Descriptions will be made later in detail on this suction purge process, a discharge process of discharging the inks discharged into the cap 25, etc.

Figure 9:
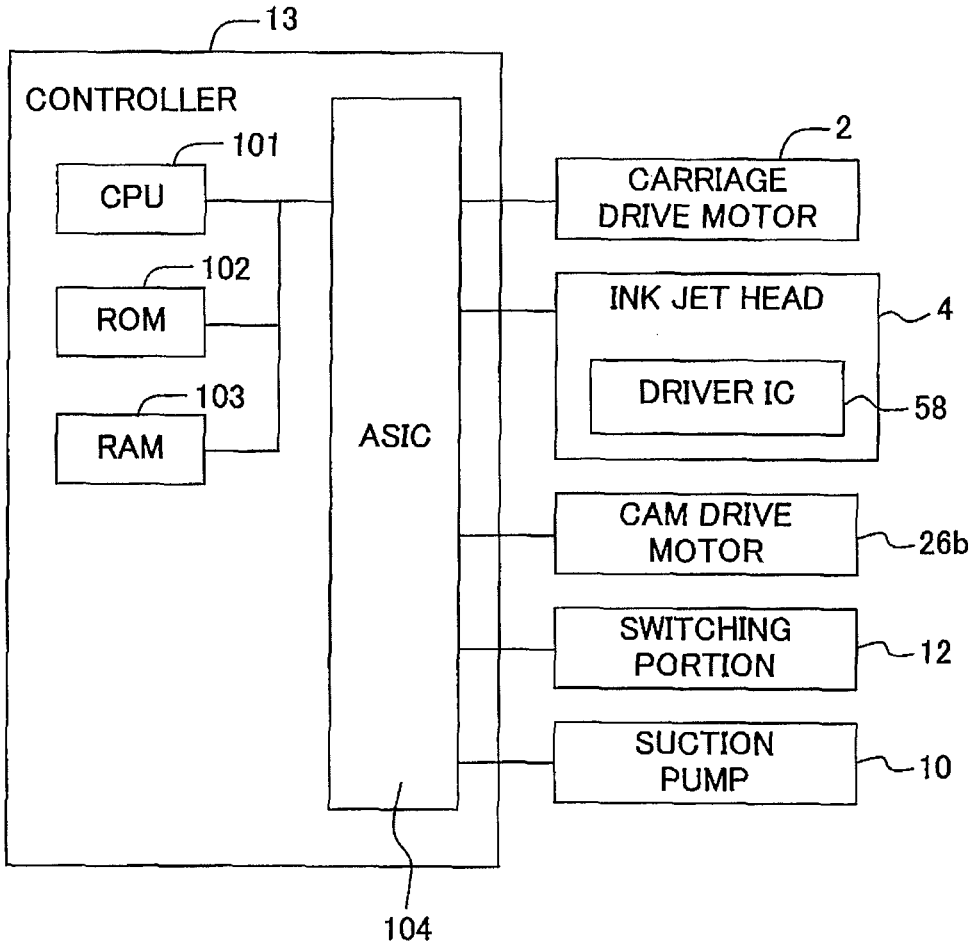
FIG. 9 is a block diagram of a control device depicted in FIG. 1.

The control device 13 includes, as depicted in FIG. 9, a CPU (Central Processing Unit) 101, a ROM (Read Only Memory) 102, a RAM (Random Access Memory) 103, an ASIC (Application Specific Integrated Circuit) 104, etc. These components cooperate to control the operations of the carriage drive motor 14, the ink jet head 4 (and an aftermentioned driver IC 58), the switching portion 12 (aftermentioned), the suction pump 10 (aftermentioned), a cam drive motor 26*b* (aftermentioned), and the like. For example, based on a print command sent from an external device such as a PC or the like, the control device 13 controls the ink jet head 4, the carriage drive motor 14 and the like to print images and the like on the paper P. Further, the control device 13 controls the carriage drive motor 14, the switching portion 12, the suction pump 10, the cam drive motor 26*b* and the like to carry out a maintenance operation such as the suction purge and the like. Further, while FIG. 9 shows one CPU 101 and one ASIC 104, the control device 13 may either include only one CPU 101 to let the one CPU 101 carry out the necessary processes collectively or include a plurality of CPUs 101 to let the plurality of CPUs 101 carry out the necessary processes in a shared manner. Further, the control device 13 may either include only one ASIC 104 to let the one ASIC 104 carry out the necessary processes collectively or include a plurality of ASICs 104 to let the plurality of ASICs 104 carry out the necessary processes in a shared manner.

(Details of the Ink Jet Head)

Figure 2:
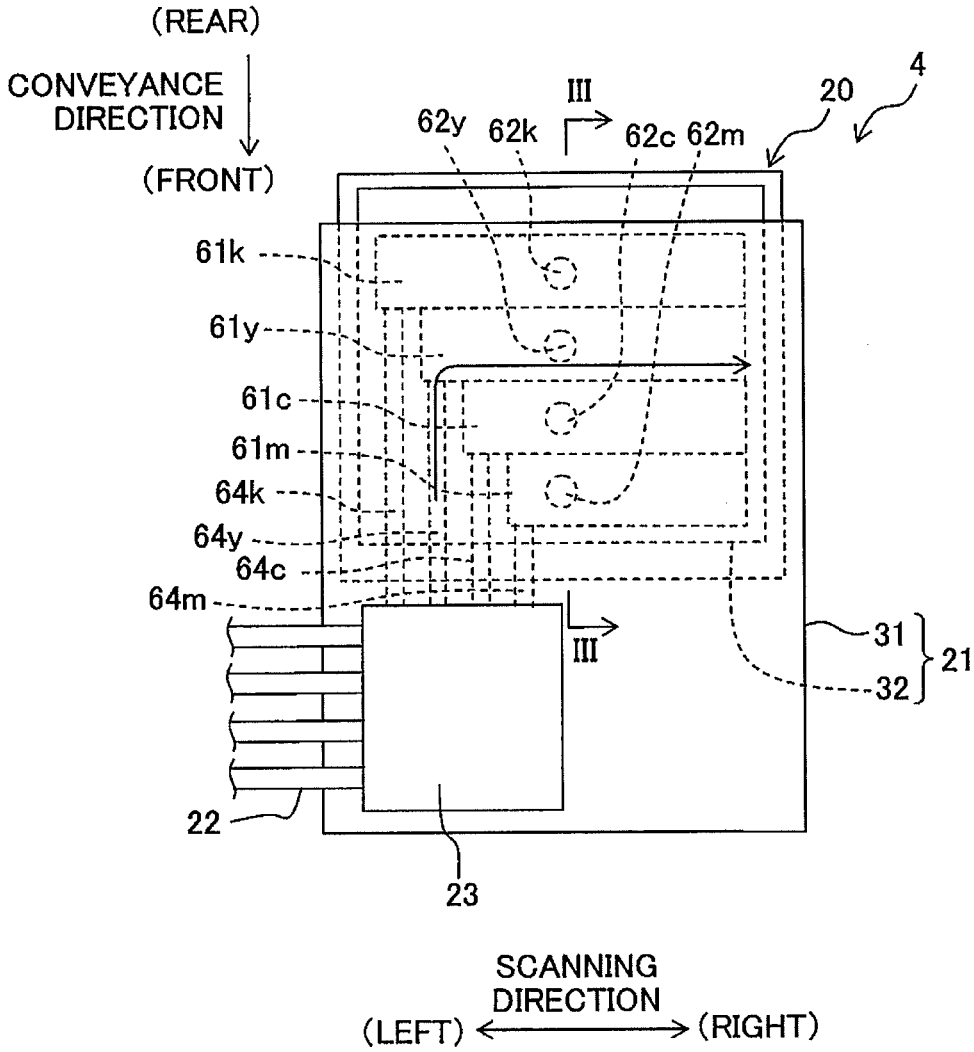
FIG. 2 is a top view of an ink jet head.
Figure 3:
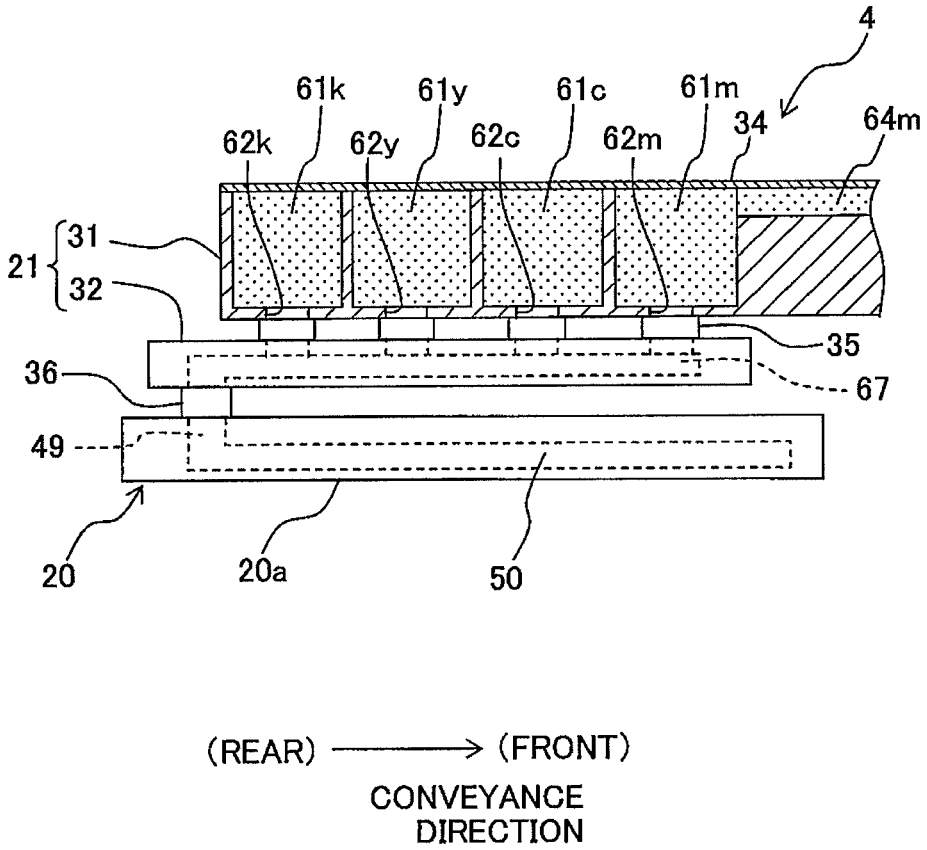
FIG. 3 is a cross-sectional view along the line of FIG. 2.

Next, a detailed configuration of the ink jet head 4 will be explained. The ink jet head 4 has, as depicted in FIGS. 2 and 3, the head portion 20, and the ink supply portion 21 arranged over the head portion 20. Further, for simplification of the drawing, FIG. 3 only shows the sub-tank 31 of the ink supply portion 21 in a cross section, but shows the head portion 20 and a distribution member 32 of the ink supply portion 21 in a lateral view.

<Configuration of the Head Portion>

Figure 4:
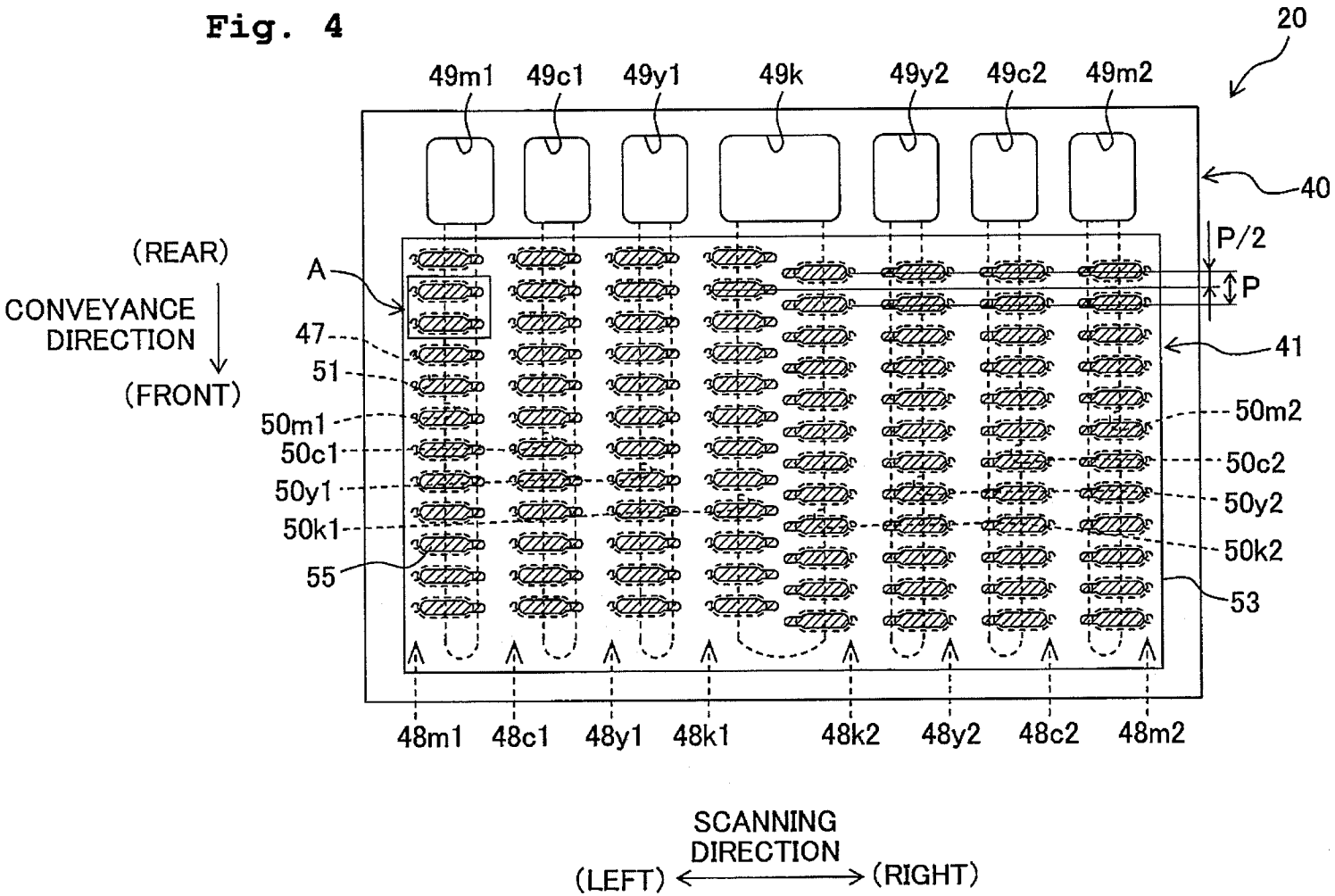
FIG. 4 is a top view of a head portion.
Figure 5A:
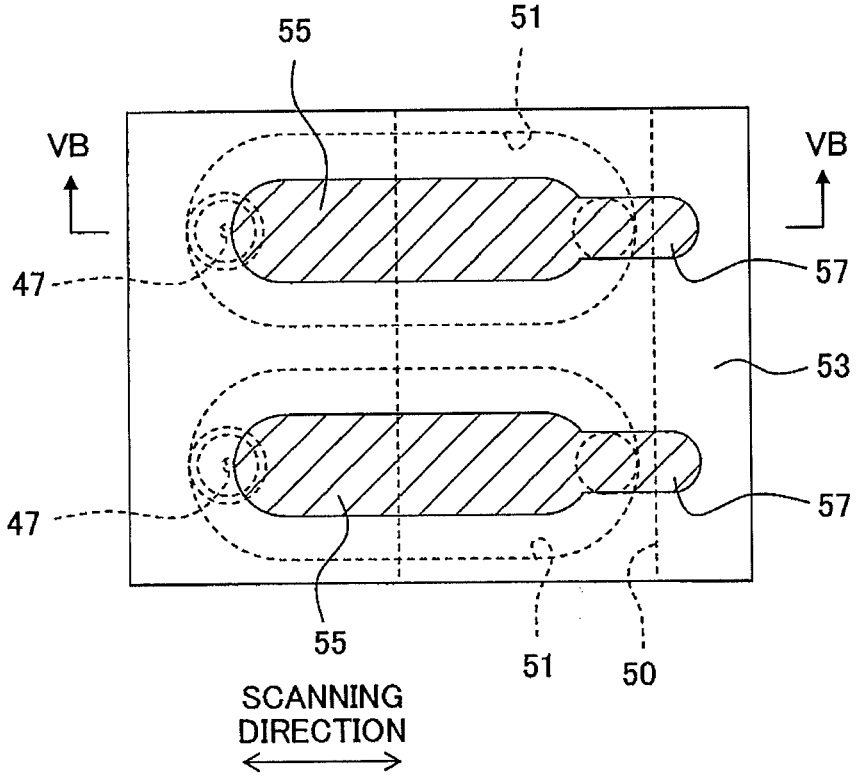
FIG. 5A is an enlarged view of part A of FIG. 4.
Figure 5B:
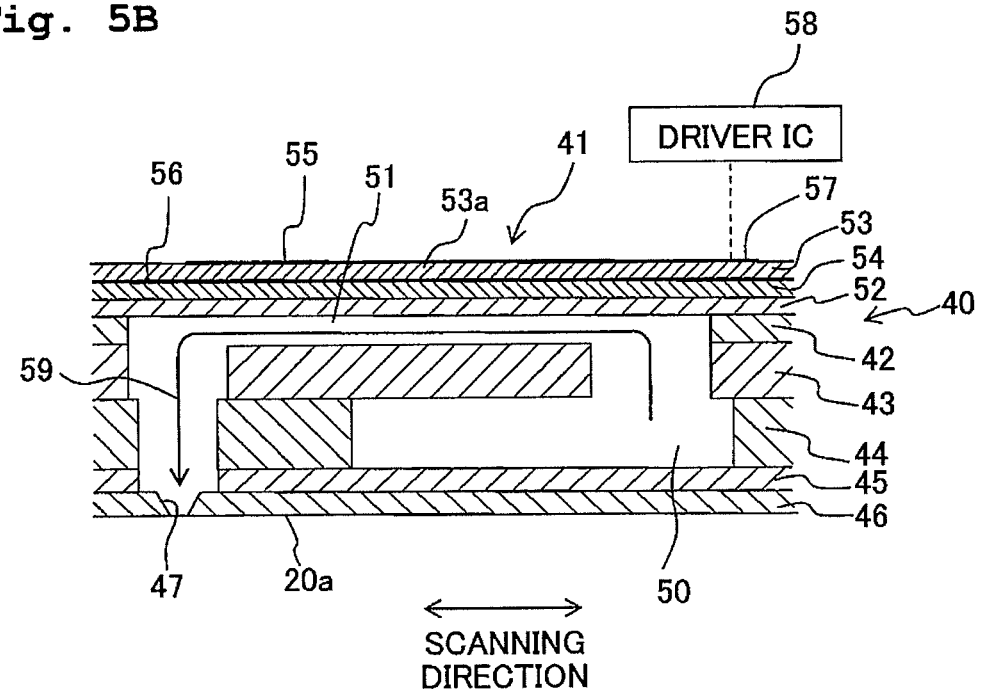
FIG. 5B is a cross-sectional view along the line VB-VB of FIG. 5A.

First, a configuration of the head portion 20 will be explained. As depicted in FIG. 4 and FIGS. 5A and 5B, the head portion 20 has a channel unit 40 and a piezoelectric actuator 41.

(The Channel Unit)

As depicted in FIG. 5B, the channel unit 40 has such a structure that five plates 42 to 46 are stacked on each other. Among the five plates 42 to 46, the lowermost-layer plate 46 is a nozzle plate in which the plurality of nozzles 47 are formed. On the other hand, channels are formed in the other four upper plates 42 to 45, such as manifolds 50, pressure chambers 51 and the like in communication with the plurality of nozzles 47.

Referring to FIG. 4 in particular, an explanation will be made on arraying the plurality of nozzles 47 formed in the nozzle plate 46. In the nozzle plate 46, the plurality of nozzles 47 are arrayed at intervals of pitch P along a direction (one direction) parallel to the conveyance direction, and these plurality of nozzles 47 form a total of eight nozzle groups 48 aligning in the scanning direction.

The eight nozzle groups 48 are formed of two nozzle groups 48*k*1 and 48*k*2 jetting the black ink, two nozzle groups 48*y*1 and 48*y*2 jetting the yellow ink, two nozzle groups 48*c*1 and 48*c*2 jetting the cyan ink, and two nozzle groups 48*m*1 and 48*m*2 jetting the magenta ink. Further, between two nozzle groups 48 jetting the ink of the same color (for example, the two nozzle groups 48*k*1 and 48*k*2), the nozzles 47 deviate in position according to a nozzle arrayal direction by half the pitch P (P/2) in each nozzle group 48.

The two nozzle groups 48*k*1 and 48*k*2 for black are arranged adjacent to each other in the center according to the scanning direction. The two nozzle groups 48*y*1 and 48*y*2 for yellow are arranged on both sides of the two nozzle groups 48*k*1 and 48*k*2 for black according to the scanning direction to interpose these two nozzle groups 48*k*1 and 48*k*2 for black. The two nozzle groups 48*c*1 and 48*c*2 for cyan are arranged further outward on both sides and, moreover, the two nozzle groups 48*m*1 and 48*m*2 for magenta are arranged still further outward on both sides. That is, the nozzle groups 48 for the four types of inks of black, yellow, cyan and magenta are arranged bisymmetrically.

Further, the plurality of nozzles 47 forming the nozzle groups 48*y*1, 48*c*1 and 48*m*1 on the left of the two nozzle groups 48*k*1 and 48*k*2 jetting the black ink correspond to the plurality of first nozzles of the present teaching. The plurality of nozzles 47 forming the nozzle groups 48*y*2, 48*c*2 and 48*m*2 on the right of the two nozzle groups 48*k*1 and 48*k*2 jetting the black ink correspond to the plurality of second nozzles of the present teaching. The plurality of nozzles 47 forming the two nozzle groups 48*k*1 and 48*k*2 jetting the black ink correspond to the plurality of third nozzles of the present teaching.

By virtue of this, in a so-called bidirectional print, between the occasion of moving the carriage 3 to one side in the scanning direction and the occasion of moving the carriage 3 to the other side in the scanning direction, by separately using the four nozzle groups 48 on the left and those on the right, regardless of the moving direction of the carriage 3, it is possible to constantly form one dot by landing the four types of inks on the paper P in the same order (magenta, cyan, yellow and black). That is, by the above nozzle arrayal, while adopting the bidirectional print to raise the recording speed, it is possible to record high quality images and the like by the same coloration of each dot.

Further, without being limited to a bisymmetrical arrangement as depicted in FIG. 4, it is possible to change as appropriate the arrangement of the nozzle groups 48*m*, 48*c* and 48*y* for the three colors separated from the left side to the right side across the nozzle group 48*k* for black. For example, on both the left side and the right side of the nozzle group 48*k*, the nozzle groups 48*m*, 48*c* and 48*y* for the three colors may be respectively arranged in the order of magenta, cyan, and yellow from the left.

Next, an explanation will be made on a channel structure formed in the upper four plates 42 to 45 of the channel unit 40 to communicate with the plurality of nozzles 47. First, as depicted in FIG. 4, seven supply ports 49 aligning in the scanning direction are formed in such an end portion of the upper surface of the channel unit 40 as on the upstream side according to the conveyance direction. These supply ports 49 (the liquid supply ports) are supplied with the four types of inks from the ink supply portion 21 described later. The seven supply ports 49 are a supply port 49*k* for black, two supply ports 49*y*1 and 49*y*2 for yellow, two supply ports 49*c*1 and 49*c*2 for cyan, and two supply ports 49*m*1 and 49*m*2 for magenta.

The seven supply ports 49 are aligned in the scanning direction in the order corresponding to the aforementioned arrangement of the nozzle groups 48 for the four colors. In detail, first, the supply port 49*k* for black is arranged in the center according to the scanning direction. Then, on the outward (leftward and rightward) sides from the supply port 49*k* for black, the supply ports 49*y* for yellow, the supply ports 49*c* for cyan and the supply ports 49*m* for magenta are bisymmetrically arranged in this order, respectively. That is, the two supply ports 49*y* for yellow are arranged to interpose the supply port 49*k* for black in the scanning direction, the two supply ports 49*c* for cyan are arranged to interpose the three supply ports 49*k* and 49*y* in the scanning direction, and the two supply ports 49*m* for magenta are arranged to interpose the five supply ports 49*k*, 49*y* and 49*c* in the scanning direction. Further, the supply port 49*k* for black has a larger opening size than the other six supply ports 49 for supplying the black ink to each of the two nozzle groups 48*k*1 and 48*k*2.

Further, inside the channel unit 40, the seven manifolds 50 are formed to extend respectively in the conveyance direction. The seven manifolds 50 are connected respectively with the seven supply ports 49 at the rear ends thereof. The manifold 50*k* is supplied with the black ink from the supply port 49*k*. The manifolds 50*y*1 and 50*y*2 are supplied with the yellow ink from the supply ports 49*y*1 and 49*y*2. The manifolds 50*c*1 and 50*c*2 are supplied with the cyan ink from the supply ports 49*c*1 and 49*c*2. The manifolds 50*m*1 and 50*m*2 are supplied with the magenta ink from the supply ports 49*m*1 and 49*m*2. Further, in the same manner as in the other ink channels, in the black ink channel, it is also possible to provide two supply ports 49*k* and/or two manifolds 50*k* to correspond respectively to the two nozzle groups 48*k*1 and 48*k*2.

The manifolds 50 for the four colors of black, yellow, cyan and magenta are arranged bisymmetrically in the same manner as the aforementioned nozzle groups 48 for the four colors. That is, the manifolds 50*k* are arranged in the center according to the scanning direction. The two manifolds 50*y*1 and 50*y*2 for yellow are arranged on both sides of the manifold 50*k* to interpose the manifold 50*k*. The two manifolds 50*c*1 and 50*c*2 for cyan are arranged on both sides thereof and, moreover, the two manifolds 50*m*1 and 50*m*2 for magenta are arranged further on both sides thereof.

Further, the channel unit 40 has the plurality of pressure chambers 51 corresponding respectively to the plurality of nozzles 47. The plurality of pressure chambers 51 are formed in the plate 42 positioned as the upmost layer of the channel unit 40, and arranged in a plane to correspond respectively to the plurality of nozzles 47. As depicted in FIG. 4, the pressure chambers 51 are arrayed in eight rows along the conveyance direction to locate above the manifolds 50 and to correspond respectively to the eight nozzle groups 48. Further, because the two nozzle groups 48*k*1 and 48*k*2 for black are arranged adjacent to each other in the scanning direction, and thus the two corresponding pressure chamber rows are also adjacent to each other, the two pressure chamber rows for black are in common communication with the one manifold 50*k* positioned right thereunder. On the other hand, each of the pressure chamber rows corresponding to the other nozzle groups 48 is in communication with the one manifolds 50 positioned right thereunder. In the above manner, as depicted by the arrow in FIG. 5B, inside the channel unit 40, a plurality of individual channels 59 are formed to branch from each manifolds 50, pass through the pressure chambers 51, and reach the nozzles 47. That is, the plurality of individual channels 59 in respective communication with the plurality of nozzles 47 forming the nozzle groups 48*y*1, 48*c*1 and 48*m*1 on the left side in FIG. 4 correspond to the first individual channels of the present teaching. The plurality of individual channels 59 in respective communication with the plurality of nozzles 47 forming the nozzle groups 48*y*2, 48*c*2 and 48*m*2 on the right side correspond to the second individual channels of the present teaching.

<The Piezoelectric Actuator>

The piezoelectric actuator 41 is joined to the upper surface of the channel unit 40 to cover the plurality of pressure chambers 51. As depicted in FIGS. 4 and FIGS. 5A and 5B, the piezoelectric actuator 41 has a vibration plate 52, two piezoelectric layers 53 and 54, a plurality of individual electrodes 55, and a common electrode 56.

The vibration plate 52 is a thin plate formed of a material of low ink permeability, for example, a metallic material such as stainless steel or the like. The vibration plate 52 is joined to the upper surface of the channel unit 40 to cover the plurality of pressure chambers 51.

The two piezoelectric layers 53 and 54 are made respectively of a piezoelectric material whose primary ingredient is lead zirconate titanate which is a mixed crystal of lead titanate and lead zirconate. The piezoelectric layers 53 and 54 are arranged on the upper surface of the vibration plate 52 in such a state as stacked on each other.

The plurality of individual electrodes 55 are arranged on the upper surface of the upper piezoelectric layer 53. In more detail, as depicted in FIG. 4 and FIGS. 5A and 5B, each of the individual electrodes 55 is arranged in such an area of the upper surface of the piezoelectric layer 53 as to face the central portion of the corresponding pressure chamber 51. The plurality of individual electrodes 55 are arrayed to correspond respectively to the plurality of pressure chambers 52, and to form a total of eight individual electrode rows. An individual terminal 57 extends out from each of the individual electrodes 55. The plurality of individual terminals 57 are connected with a wiring member (not depicted) on which a driver IC 58 mounted. By virtue of this, the plurality of individual electrodes 55 are electrically connected with the driver IC 58. The driver IC 58 selectively applies one of a predetermined drive potential and a ground potential to each of the individual electrodes 55.

The common electrode 56 is arranged between the two piezoelectric layers 53 and 54. The common electrode 56 faces the plurality of individual electrodes 55 in common across the piezoelectric layer 53. While illustration of a specific electrical connection structure is omitted, a connecting terminal also extends out from the common electrode 56 to the upper surface of the piezoelectric layer 53 and, in the same manner as the plurality of individual electrodes 55, is connected with the wiring member. Connected with a ground wire formed in the wiring member, the common electrode 56 is constantly maintained at the ground potential.

Further, such a portion of the piezoelectric layer 53 as sandwiched between the individual electrodes 55 and the common electrode 56 (referred to as an active portion 53*a*) is polarized in a thickness direction (downward). The active portion 53*a* is a portion where a piezoelectric deformation (piezoelectric strain) occurs when a potential difference arises between the individual electrodes 55 and the common electrode 56 to bring about action of an electric field in the thickness direction.

An explanation will be made on how the piezoelectric actuator 41 operates. When the driver IC 58 applies the drive potential to a certain one of the individual electrodes 55, then the potential difference arises between that individual electrode 55 and the common electrode 56. At this time, the electric filed acts in the thickness direction (downward) on the active portion 53*a* of the piezoelectric layer 53 where the direction of the electric field is consistent with the polarization direction of the active portion 53*a*. Therefore, the active portion 53*a* contracts in its planar direction and, along with this, the two piezoelectric layers 53 and 54 bend to project toward the pressure chamber 51. By virtue of this, the pressure chamber 51 changes in volume to give rise to a pressure wave in the individual channel including the pressure chamber 51. Thereby, jet energy is imparted to the ink such that drops of the ink are jetted from the nozzle 47.

<Configuration of the Ink Supply Portion>

Next, the ink supply portion 21 will be explained. As depicted in FIGS. 2 and 3, the ink supply portion 21 has a sub-tank 31 and the distribution member 32.

The sub-tank 31 is such a member as formed of a synthetic resin to have a rectangular planer shape. The sub-tank 31 has four ink chambers 61 containing the four types of inks respectively. As depicted in FIG. 2, in planar view, each of the four ink chambers 61 has a rectangular shape elongated in the scanning direction. The four ink chambers 61 are arranged to align along the conveyance direction in the order of black, yellow, cyan and magenta. Further, any of the four ink chambers 61 becomes shorter in length according to the scanning direction as positioned further toward the downstream side (the front side) according to the conveyance direction. Further, each of the four ink chambers 61 is equal to another in length according to the conveyance direction. Therefore, any of the four ink chambers 61 is smaller in area as positioned further toward the downstream side according to the conveyance direction. Further, the four ink chambers 61 are situated respectively to the right side and their right ends are uniformly positioned according to the scanning direction.

The sub-tank 31 has such a portion on the front side of each of the four ink chambers 61 as to extend respectively in the conveyance direction to form four ink introduction channels 64 connected respectively to the four ink chambers 61. Further, a tube joint 23 is fitted on the left half upper surface of a front end portion of the sub-tank 31. The four ink introduction channels 64 are connected respectively with the four ink cartridges 30 in the holder 5 via the tube joint 23 and the four tubes 22.

In a lower wall portion of the sub-tank 31, four outflow holes 62 are formed to communicate respectively with the four ink chambers 61. The four outflow holes 62 are arranged to align vertically or in a front-rear direction according to the alignment of the four ink chambers 61 in a central portion of the sub-tank 31 according to the scanning direction. The four types of inks contained in the four ink chambers 61 are sent from the four outflow holes 62 to the aftermentioned distribution member 32 arranged below.

Further, as depicted in FIG. 3, the abovementioned ink chambers 61 and ink introduction channels 64 are concave channels with open tops, respectively. Then, a flexible damper film 34 formed of a synthetic resin film or the like is provided over almost the entire area of an upper wall portion of the sub-tank 31 to commonly cover the concave channels from above. With the respective ink chambers 61 being covered by the damper film 34 from above, the respective ink chambers 61 double as damper chambers for damping pressure fluctuation of the inks.

As depicted in FIGS. 2 and 3, the distribution member 32 is a rectangular member in planar view, arranged between the head portion 20 and the sub-tank 31. The distribution member 32 is connected with the outflow holes 62 of the sub-tank 31 through communicative members 35. Further, the distribution member 32 is also connected with the supply ports 49 of the head portion 20 through a communicative member 36.

Figure 6:
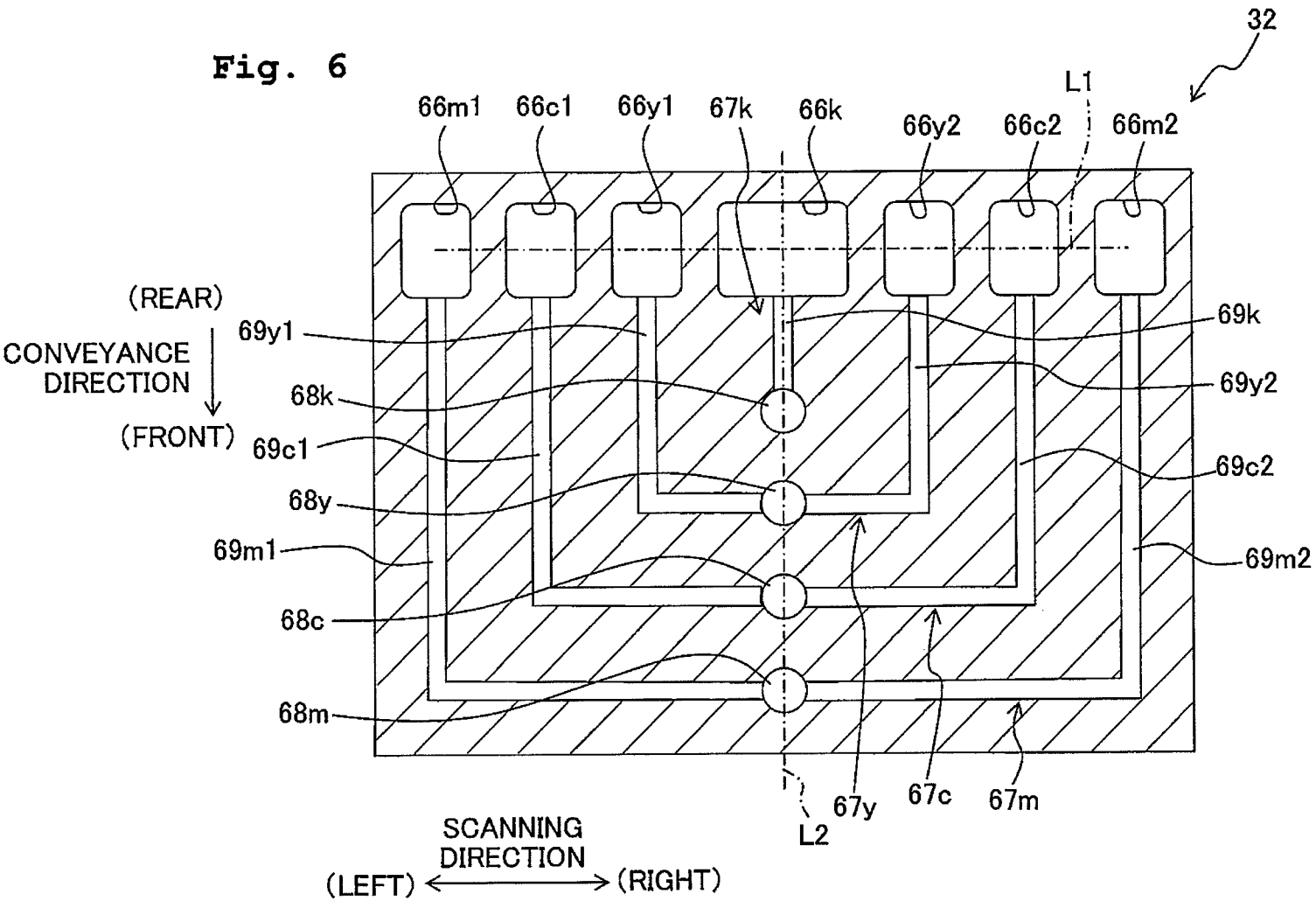
FIG. 6 is a horizontal cross-sectional view of a distribution member.

As depicted in FIG. 6, in a rear end portion of the distribution member 32, seven ink discharge ports 66 are formed to align in the scanning direction and arranged to locate respectively right above the seven supply ports 49 of the head portion 20. The seven ink discharge ports 66 are connected respectively with the seven supply ports 49 of the head portion 20 via the communicative member 36.

Further, the distribution member 32 has four connective channels 67 which respectively supply the seven supply ports 49 of the head portion 20 with the four types of inks sent from the four ink chambers 61 via the outflow holes 62 of the sub-tank 31. Each of the four connective channels 67 has a communicative hole 68 in communication with the corresponding outflow hole 62 of the sub-tank 31, and a supply channel 69 connecting the communicative hole 68 and the ink discharge port 66. The four communicative holes 68 are aligned in the front-rear direction in a central portion of the distribution member 32 according to the scanning direction to correspond to alignment of the four outflow holes 62 of the sub-tank 31.

Among the four communicative holes 68, the communicative hole 68*k* for black is positioned rearmost and, from this communicative hole 68*k*, one supply channel 69*k* extends rearward. This one supply channel 69*k* is connected with the ink discharge port 66*k* for black. On the other hand, from each of the communicative hole 68*y* for yellow, the communicative hole 68*c* for cyan and the communicative hole 68*m* for magenta, two supply channels 69 extend in the left-right direction. Further, each of these supply channels 69 turns in midstream to extend rearward to be connected with the corresponding ink discharge port 66. That is, the two supply channels 69*y*1 and 69*y*2 for yellow are connected respectively with the two ink discharge ports 66*y*1 and 66*y*2 for yellow. Likewise, the two supply channels 69*c*1 and 69*c*2 for cyan are connected respectively with the two ink discharge ports 66*c*1 and 66*c*2 for cyan, while the two supply channels 69*m*1 and 69*m*2 for magenta are connected respectively with the two ink discharge ports 66*m*1 and 66*m*2 for magenta.

As depicted in FIG. 6, as viewed from the up-down direction, the channel structure inside the distribution member 32 is bisymmetric, to supply one of the inks to each of the two ink supply ports 49 supplied with the ink of an identical color. That is, the communicative hole 68*m* for magenta is arranged on a straight line L2 orthogonal to a line segment L1 linking the two ink supply ports 49*m*1 and 49*m*2 for magenta (the ink discharge ports 66*m*1 and 66*m*2). Then, the two supply channels 69*m*1 and 69*m*2 for magenta have a line symmetric shape with respect to the straight line L2. The channels for yellow and cyan also have the same line symmetric channel structure as magenta. By virtue of this, there becomes a small difference in channel resistance between the two supply channels 69 of an identical color. Thereby, it is thus possible to keep a small difference in channel resistance between the two channels from one ink chamber 61 to each of the two supply ports 49.

Further, the plurality of individual channels 59 in respective communication with the plurality of nozzles 47 belonging to the nozzle group 48*y*1 on the left in FIG. 4, and the plurality of individual channels 59 in respective communication with the plurality of nozzles 47 belonging to the nozzle group 48*y*2 on the right communicate with the ink chamber 61*y* via a connective channel 67*y* and the manifolds 50*y*1 and 50*y*2. Further, the plurality of individual channels 59 in respective communication with the plurality of nozzles 47 belonging to the nozzle group 48*c*1, and the plurality of individual channels 59 in respective communication with the plurality of nozzles 47 belonging to the nozzle group 48*c*2 communicate with the ink chamber 61*c* via a connective channel 67*c* and the manifolds 50*c*1 and 50*c*2. Further, the plurality of individual channels 59 in respective communication with the plurality of nozzles 47 belonging to the nozzle group 48*m*1, and the plurality of individual channels 59 in respective communication with the plurality of nozzles 47 belonging to the nozzle group 48*m*2 communicate with the ink chamber 61*m* via a connective channel 67*m* and the manifolds 50*m*1 and 50*m*2. Between such kind of the connective channel 67 and the two manifolds 50 for each color, a common channel is formed to link the plurality of individual channels 59 in respective communication with the plurality of nozzles 47 for each color on the left and on the right.

<Details of the Cap Device 8>

Figure 7:
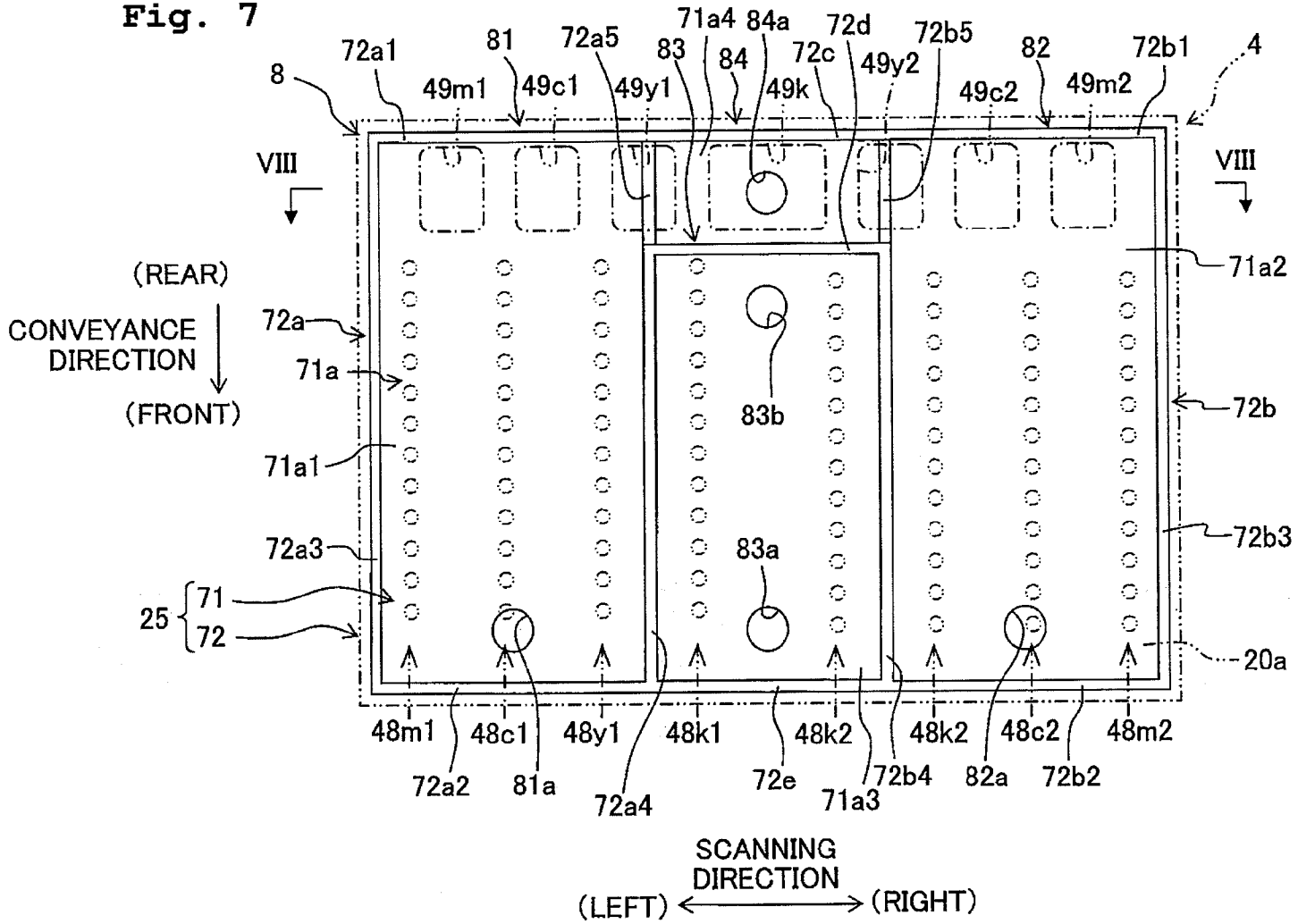
FIG. 7 is a plan view of a cap depicted in FIG. 1.

Next, a detailed configuration of the cap device 8 will be explained. The cap 25 of the cap device 8 is made of a rubber material or the like and, as depicted in FIG. 7, has a bottom wall portion 71 formed by casting, and a lip portion 72 projecting from an upper surface 71*a* of the bottom wall portion 71. While both the bottom wall portion 71 and the lip portion 72 are formed of the rubber material in this embodiment, they may be formed of other materials than rubber as long as at least the lip portion 72 is formed of an elastic material. The bottom wall portion 71 is formed into a rectangular plate-like shape and, its upper surface 71*a* faces all the nozzles 47 of the jet surface 20*a* when the carriage 3 is moved to the rightmost position. The lip portion 72 has two surrounding projections 72*a* and 72*b*, and three projections 72*c* to 72*e* extending parallel to each other in the scanning direction to link the surrounding projections 72*a* and 72*b*. With the bottom wall portion 71 and the lip portion 72, three cap portions 81 to 83 and a communicative portion 84 are formed in the cap 25 to have a concave shape of open top.

The cap portion 81 has an inner bottom surface 71*a*1, the surrounding projection 72*a*, and a connective port 81*a*. The inner bottom surface 71*a*1 (the first inner bottom surface) is an area facing the three nozzle groups 48*y*1, 48*c*1 and 48*m*1 of the upper surface 71*a*. The inner bottom surface 71*a*1 is enclosed by the surrounding projection 72*a* projecting upward from its rim. The surrounding projection 72*a* (the first surrounding projection) has two extension portions 72*a*1 and 72*a*2 extending in the scanning direction, and three extension portions 72*a*3 to 72*a*5 extending in the conveyance direction, to form a circular shape connecting those extension portions 72*a*1 to 72*a*5 to each other. The extension portion 72*a*4 and the extension portion 72*a*5 are arranged at the same position according to the scanning direction and aligned in the conveyance direction to connect each other. The extension portion 72*a*5 (the first portion) is arranged at a position to face the supply port 49*y*1, and has a smaller amount of projection from the inner bottom surface 71*a*1 than the other extension portions (the extension portions 72*a*1 to 72*a*4). The extension portion 72*a*5 in this embodiment is formed lower than the other extension portions 72*a*1 to 72*a*4 by 3 mm or so. Further, except the extension portion 72*a*5 of the surrounding projection 72*a*, the other extension portions 72*a*1 to 72*a*4 are formed identical in height. The connective port 81*a* (the first connective port) is formed in the inner bottom surface 71*a*1 on the downstream side (front side) according to the conveyance direction.

The cap portion 82 has an inner bottom surface 71*a*2, the surrounding projection 72*b*, and a connective port 82*a*. The inner bottom surface 71*a*2 (the second inner bottom surface) is an area facing the three nozzle groups 48*y*2, 48*c*2 and 48*m*2 of the upper surface 71*a*, and is arranged at the same level in height as the inner bottom surface 71*a*1. The inner bottom surface 71*a*2 is enclosed by the surrounding projection 72*b* projecting upward from its rim. The surrounding projection 72*b* (the second surrounding projection) has two extension portions 72*b*1 and 72*b*2 extending in the scanning direction, and three extension portions 72*b*3 to 72*b*5 extending in the conveyance direction, to form a circular shape connecting those extension portions 72*b*1 to 72*b*5 to each other. The extension portion 72*b*4 and the extension portion 72*b*5 are arranged at the same position according to the scanning direction and aligned in the conveyance direction to connect each other. In this manner, there is a bisymmetrical arrangement between the extension portions 72*a*1 to 72*a*5 constituting the surrounding projection 72*a*, and the extension portions 72*b*1 to 72*b*5 constituting the surrounding projection 72*b*. The extension portion 72*b*5 (the second portion) is arranged at a position to face the supply port 49*y*2, and has a smaller amount of projection from the inner bottom surface 71*a*2 than the other extension portions (the extension portions 72*b*1 to 72*b*4). The extension portion 72*b*5 in this embodiment is formed lower than the other extension portions 72*b*1 to 72*b*4 by 3 mm or so. Further, except the extension portion 72*b*5 of the surrounding projection 72*b*, the other extension portions 72*b*1 to 72*b*4 are formed identical in height. The connective port 82*a* (the second connective port) is formed in the inner bottom surface 71*a*2 on the downstream side (front side) according to the conveyance direction.

The cap portion 83 has an inner bottom surface 71*a*3, two projections 72*d* and 72*e*, two extension portions 72*a*4 and 72*b*4, and two connective ports 83*a* and 83*b*. The inner bottom surface 71*a*3 (the fourth inner bottom surface) is an area facing the two nozzle groups 48*k*1 and 48*k*2 of the upper surface 71*a*, and is arranged at the same level in height as the inner bottom surface 71*a*1. The inner bottom surface 71*a*3 is enclosed by the projections 72*d* and 72*e* projecting upward from its rim, and the extension portions 72*a*4 and 72*b*4. That is, these projections 72*d* and 72*e* and the extension portions 72*a*4 and 72*b*4 are connected to each other to form a surrounding projection. In this manner, this surrounding projection of the cap portion 83 has the extension portions 72*a*4 and 72*b*4 and the projection 72*d* to share common parts with the cap portions 81 and 82 and the communicative portion 84. By virtue of this, it is possible to simply configure the cap portion 83. Further, each of the projections 72*d* and 72*e* and the extension portions 72*a*4 and 72*b*4 is formed identical in height. The connective port 83*a* (the fourth connective port) is formed in the inner bottom surface 71*a*3 on the downstream side (front side) according to the conveyance direction. The connective port 83*b* is formed in the inner bottom surface 71*a*3 on the upstream side (rear side) according to the conveyance direction.

The communicative portion 84 has an inner bottom surface 71*a*4, a pair of projections 72*c* and 72*d*, and a connective port 84*a*. The inner bottom surface 71*a*4 (the third inner bottom surface) is an area facing the supply ports 49*k*, 49*y*1 and 49*y*2, and is arranged at the same level in height as the inner bottom surface 71*a*1. The inner bottom surface 71*a*4 is enclosed by the pair of projections 72*c* and 72*d* projecting upward from its rim, and the two extension portions 72*a*5 and 72*b*5. The projection 72*c* is arranged at the same position as the extension portions 72*a*1 and 72*b*1 according to the conveyance direction, and its one end is connected to the rear end of the extension portion 72*a*5 while its other end is connected to the rear end of the extension portion 72*b*5. The projection 72*d* is arranged to separate from the projection 72*c* in the conveyance direction, and its one end is connected to the front end of the extension portion 72*a*5 while its other end is connected to the front end of the extension portion 72*b*5. The pair of projections 72*c* and 72*d* are formed identical in height, and higher than the extension portions 72*a*5 and 72*b*5. The connective port 84*a* (the third connective port) is formed in the center of the inner bottom surface 71*a*4.

Figure 8A:
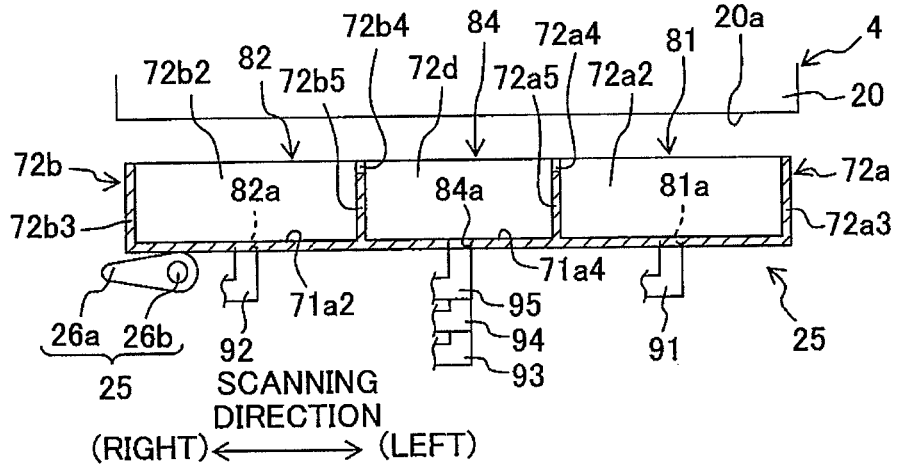
Figure 8B:
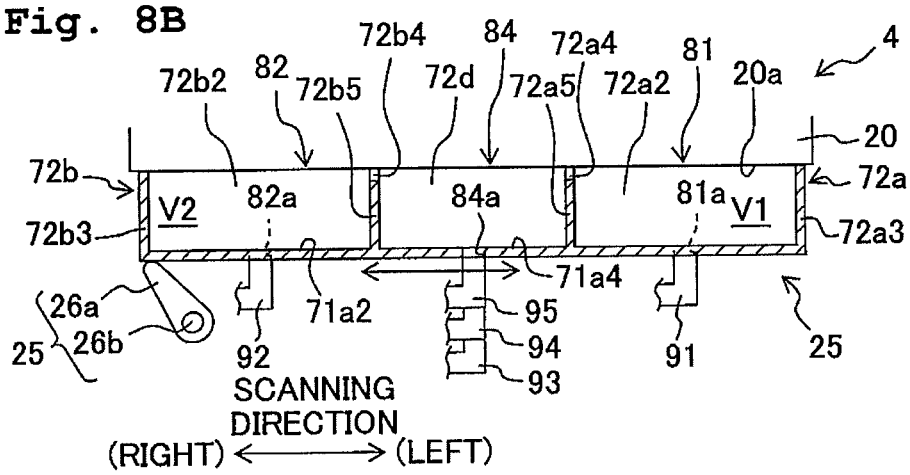
Figure 8C:
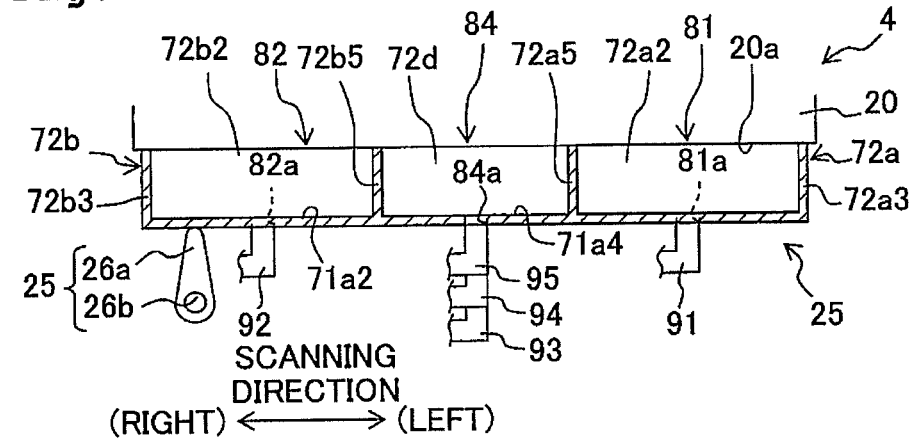

As depicted in FIGS. 8A to 8C, the cap drive mechanism 26 (the movement mechanism) has a cam 26*a* and a cam drive motor 26*b*. The cam 26*a* is arranged such that its outer periphery contacts with the bottom wall portion 71. The cam 26*a* has a predetermined contour, and is driven by the cam drive motor 26*b*.

As depicted in FIG. 8A, with the jet surface 20*a* facing the cap 25, when the cam 26*a* rotates about 50° clockwise from the state depicted in FIG. 8A, then the cap 25 is raised due to the contour of the cam 26*a*. In this manner, there comes a first contact state such that the fore-end portions of the lip portion 72 other than the extension portions 72*a*5 and 72*b*5 are in contact with the head portion 20 from a separated state of separating the lip portion 72 from the jet surface 20*a*. In the first contact state, with a first space V1 enclosed by the jet surface 20*a* and the cap portion 81 being in communication with a second space V2 enclosed by the jet surface 20*a* and the cap portion 82 through the communicative portion 84, the insides thereof are sealed up from the outside. That is, being in communication with each other via the communicative portion 84, the cap portions 81 and 82 cover the six nozzle groups 48*y*1, 48*y*2, 48*c*1, 48*c*2, 48*m*1, and 48*m*2.

As depicted in FIG. 8C, when the cam 26*a* is turned further to rotate clockwise about 90° from the state depicted in FIG. 8A, then the cap 25 is further raised from the state depicted in FIG. 8B due to the contour of the cam 26*a*. That is, a vertical separation distance between the jet surface 20*a* and each of the inner bottom surfaces 71*a*1 to 71*a*4 becomes less than that in the first contact state. In this manner, there comes a second contact state for the entire fore-end of the lip portion 72 to contact with the jet surface 20. That is, the extension portions 72*a*5 and 72*b*5 of the lip portion 72 are also in contact with the jet surface 20*a*. Further, the portion of the lip portion 72 in contact with the jet surface 20*a* in the first contact state undergoes elastic deformation to be maintained in the state of contact with the jet surface 20*a*. In this second contact state, because the fore-ends of the extension portions 72*a*5 and 72*b*5 are also in contact with the jet surface 20*a*, the first space V1 and the second space V2 are individually sealed up from the outside. That is, the cap portion 81 cover and seal up the three nozzle groups 48*y*1, 48*c*1 and 48*m*1, while the cap portion 82 cover and seal up the three nozzle groups 48*y*2, 48*c*2 and 48*m*2. Further, a third space enclosed by the jet surface 20*a* and the cap portion 83 is sealed up in any of the contact states.

On the other hand, when the cam 26*a* is rotated 90° counterclockwise from the state depicted in FIG. 8C, then as depicted in FIG. 8A, the cap 25 comes down along the contour of the cam 26*a*. In this manner, the lip portion 72 comes away from the head portion 20 into the separated state.

Here, the cap drive mechanism 26 may also be configured, for example, not to have any drive source such that the cap 25 is raised as being pressed by the carriage 3 when the carriage 3 is approaching the cap 25 in the scanning direction, whereas the cap 25 is lowered as no longer being pressed by the carriage 3 when the carriage 3 is coming away from the cap 25 in the scanning direction (to return to the position before being raised). Further, the movement mechanism may be configured either to raise and lower only the ink jet head 4 or the carriage 3 or to raise and lower the ink jet head 4 or the carriage 3 and the cap 25. Further, in such cases, the cap 25 may be raised and lowered when the respective inner bottom surfaces 71*a*1 to 71*a*4 face the jet surface 20*a*.

<Details of the Suction Device>

Next, a detailed configuration of the suction device 9 will be explained. The switching portion 12 of the suction device 9 is connected with the cap 25 via the five tubes 91 to 95. The tube 91 is connected with the connective port 81*a*, the tube 92 is connected with the connective port 82*a*, the tube 93 is connected with the connective port 83*a*, the tube 94 is connected with the connective port 83*b*, and the tube 95 is connected with the connective port 84*a*. Further, the switching portion 12 is connected with the suction pump 10 via the tube 96. While these tubes 91 to 96 are flexible, they may not particularly be flexible but be any hollow tubing members.

The switching portion 12 is configured to be capable of selectively taking any of first to fourth communication states of the suction pump 10 in communication with any of the four connective ports 81*a*, 82*a*, 83*a* and 84*a*. The first communication state refers to the suction pump 10 in communication with the connective port 81*a*, the second communication state refers to the suction pump 10 in communication with the connective port 82*a*, the third communication state refers to the suction pump 10 in communication with the connective port 84*a*, and the fourth communication state refers to the suction pump 10 in communication with the connective port 83*a*. Further, the connective ports 81*a*, 82*a* and 83*a* come into a shutoff state without communication with the atmosphere when not in the state of communication with the suction pump 10. Further, the switching portion 12 is configured to be capable of selectively taking a first atmosphere communication state of causing the connective port 84*a* to communication with the atmosphere and a first shutoff state of causing the connective port 84*a* not to communication with the atmosphere, when the third communication state is not selected. Further, the switching portion 12 is also configured to be capable of selectively taking a second atmosphere communication state of causing the connective port 83*b* to communication with the atmosphere and a second shutoff state of causing the connective port 83*b* not to communication with the atmosphere.

The suction pump 10 is a tubular pump or the like and, as depicted in FIG. 1, is connected to the waste tank 11 via the tube 97. The waste tank 11 retains the inks discharged in a maintenance operation described below.

<Maintenance Operation>

Next, referring to FIGS. 8A to 8C, and FIG. 10 through FIGS. 13A to 13D, a maintenance operation for the printer 1 will be explained below. Further, FIGS. 11A to 11D and FIGS. 13A to 13D depict the same cross section as the FIGS. 8A to 8C. When the printer 1 is not used for a long time or the like, then the inks inside the nozzles 47 may be thickened to give rise to ink jet defection of the nozzles 47. Hence, the printer 1 is configured to carry out the maintenance operations such as a periodic purge to discharge the inks periodically, a manual purge to discharge the inks according to the user's operation of operation panel (not depicted) or the like of the printer 1, etc. Further, the manual purge is carried out when it is not possible for the periodic purge to recover the function from the ink jet defection.

<The Periodic Purge>

Figure 10:
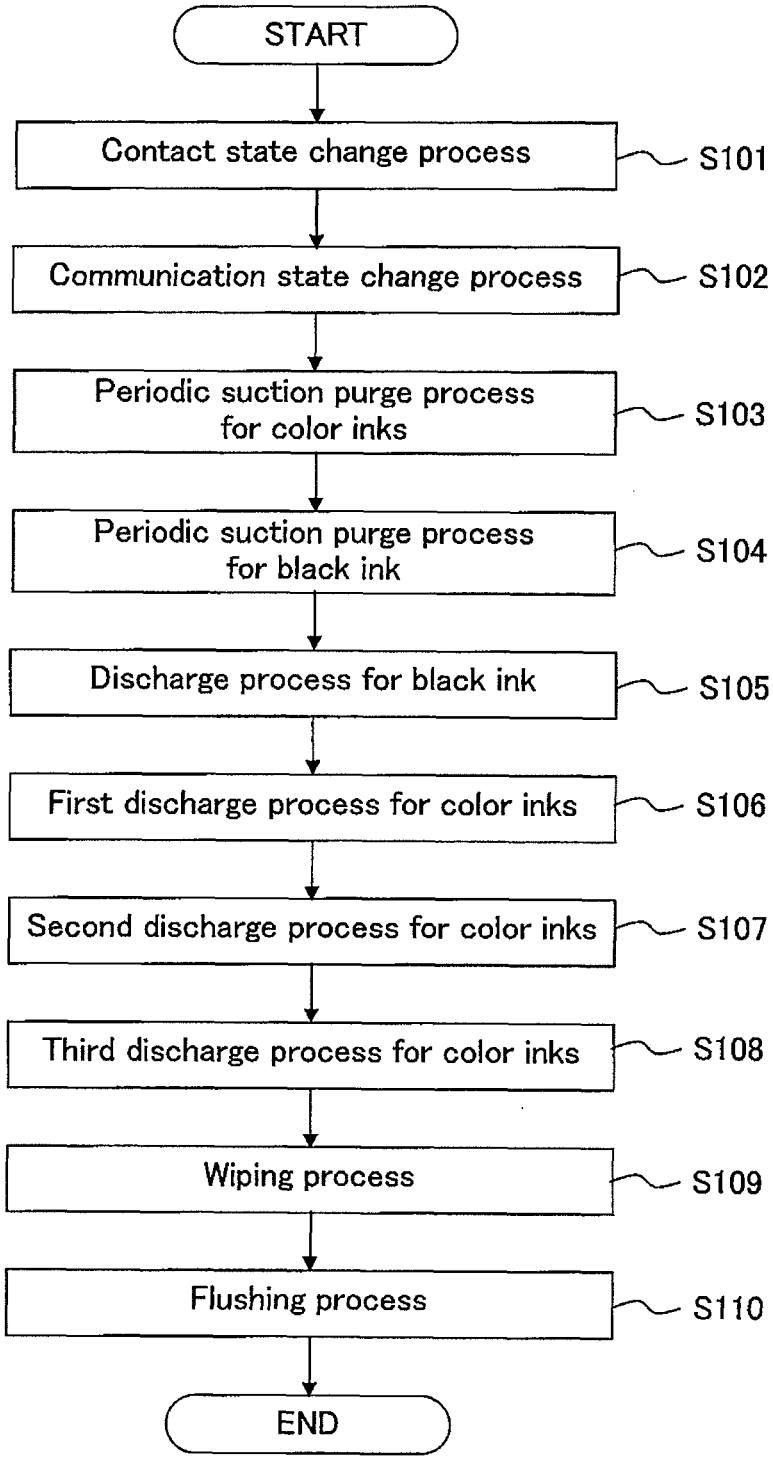
FIG. 10 is a flowchart showing a procedure of a maintenance operation for a periodic purge.

In the maintenance operation of carrying out the periodic purge, first, as depicted in FIG. 10, a contact state change process is carried out (step S101). On this occasion, the control device 13 controls the carriage drive motor 14 to let the cap 25 face the jet surface 20*a* as depicted in FIG. 8A. Thereafter, it controls the cam drive motor 26*b* to take the first contact state from the separated state as depicted in FIG. 8B, to come into a capping state. By virtue of this, with the first space V1 in communication with the second space V2 through the communicative portion 84, the cap portions 81 and 82 cover the six nozzle groups 48*y*1, 48*y*2, 48*c*1, 48*c*2, 48*m*1 and 48*m*2. Further, on this occasion, the cap portion 83 covers the two nozzle groups 48*k*1 and 48*k*2. Further, in the following explanation, the word "step" will be omitted such that "step S101" is simply written as "S101", etc.

Next, a communication state change process is carried out (S102). On this occasion, the control device 13 controls the switching portion 12 to take the first communication state and, meanwhile, take the second shutoff state. By virtue of this, the third space enclosed by the jet surface 20*a* and the cap portion 83 is sealed up. Further, while the first communication state is taken in this embodiment, the second communication state may be taken instead.

Figure 11A:
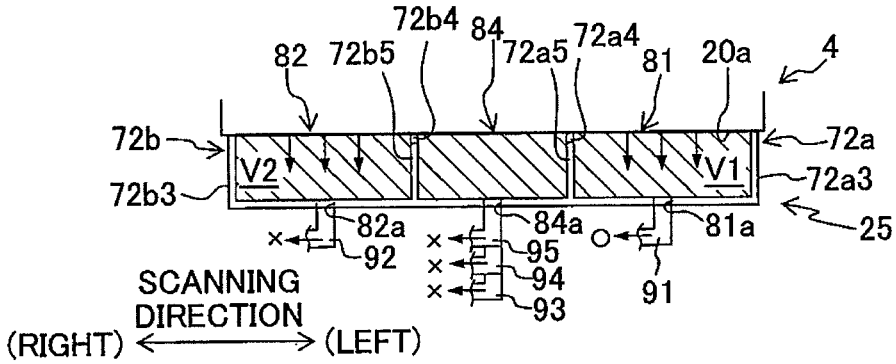

Next, a periodic suction purge process is carried out for the color inks (S103: the third purge process). On this occasion, the control device 13 controls the switching portion 12 to take the first shutoff state, and drives the suction pump 10 in the first contact state at a predetermined rotary speed for a predetermined time. In so doing, the barometric pressure inside the space between the jet surface 20*a* and the cap 25 via the connective port 81*a* (the first space V1 and the second space V2 in communication with each other via the communicative portion 84) decreases to a first predetermined barometric pressure. The first predetermined barometric pressure is capable of breaking the ink meniscus of any of the nozzles 47 to discharge the ink from that nozzle 47. Therefore, the color inks are discharged to the cap portions 81 and 82 from the plurality of nozzles 47 belonging to the six nozzle groups 48*y*1, 48*y*2, 48*c*1, 48*c*2, 48*m*1 and 48*m*2. In this manner, as depicted in FIG. 11A by way of hatching, inks are retained in the cap portions 81 and 82, while the color inks flowing into the communicative portion 84 from the cap portion 82 are retained in the communicative portion 84. Further, in FIGS. 11A to 11D, the mark "○" shows a communicable state, while the mark "x" shows a state of shutting off the communication.

Next, a periodic suction purge process is carried out for the black ink (S104). On this occasion, the control device 13 controls the switching portion 12 to take the fourth communication state, and drives the suction pump 10 in the first contact state at a predetermined rotary speed for a predetermined time. In so doing, the barometric pressure inside the third space enclosed by the jet surface 20*a* and the cap portion 83 via the connective port 83*a* decreases to a predetermined barometric pressure. The predetermined barometric pressure mentioned here is also capable of breaking the ink meniscus of any of the nozzles 47 jetting the black ink to discharge the ink from that nozzle 47. Therefore, the black ink is discharged to the cap portion 83 from the plurality of nozzles 47 belonging to the two nozzle groups 48*k*1 and 48*k*2. In this manner, the black ink is retained in the cap portion 83.

Next, a discharge process is carried out for the black ink (S105). On this occasion, the control device 13 controls the switching portion 12 to take the second atmosphere communication state, and drives the suction pump 10 in the first contact state and in the fourth communication state at a predetermined rotary speed for a predetermined time. In so doing, air flows in from the connective port 83*b*, and thereby the black ink inside the cap portion 83 flows from the connective port 83*a* toward the suction pump 10 to be discharged to the waste tank 11.

Figure 11B:
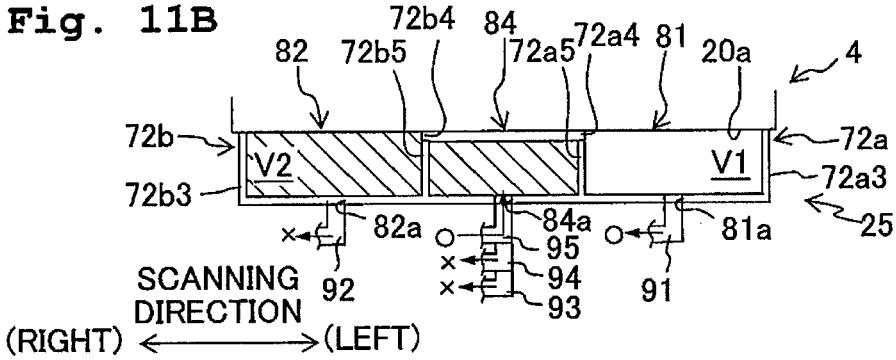

Next, a first discharge process is carried out for the color inks (S106). On this occasion, the control device 13 controls the switching portion 12 to take not only the first atmosphere communication state but also the first communication state, and drives the suction pump 10 in the first contact state and in the first communication state at a predetermined rotary speed for a predetermined time. In so doing, as depicted in FIG. 11B, air flows in from the connective port 84*a*; thereby, the color inks over the communicative portion 84 flow through the part between the extension portion 72*a*5 and the jet surface 20*a* to the cap portion 81, and the color inks inside the cap portion 81 flow from the connective port 81*a* toward the suction pump 10 to be discharged to the waste tank 11.

Figure 11C:
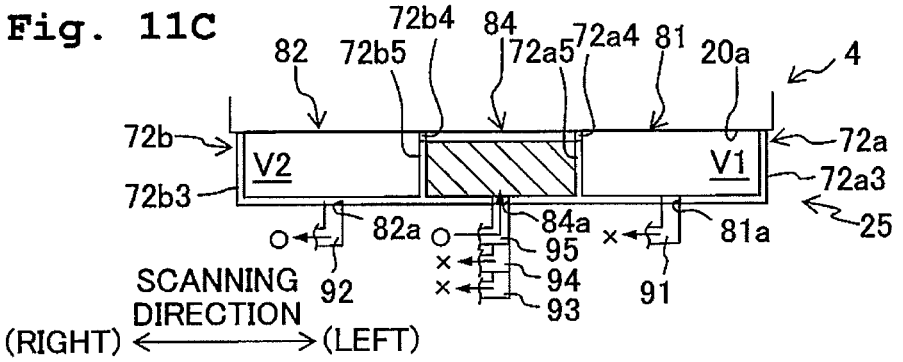

Next, a second discharge process is carried out for the color inks (S107). On this occasion, the control device 13 controls the switching portion 12 to take the second communication state, and drives the suction pump 10 in the first atmosphere communication state, in the first contact state, and in the second communication state at a predetermined rotary speed for a predetermined time. In so doing, as depicted in FIG. 11C, air flows in from the connective port 84*a*, and thereby the color inks inside the cap portion 82 flow from the connective port 82*a* toward the suction pump 10 to be discharged to the waste tank 11.

Figure 11D:
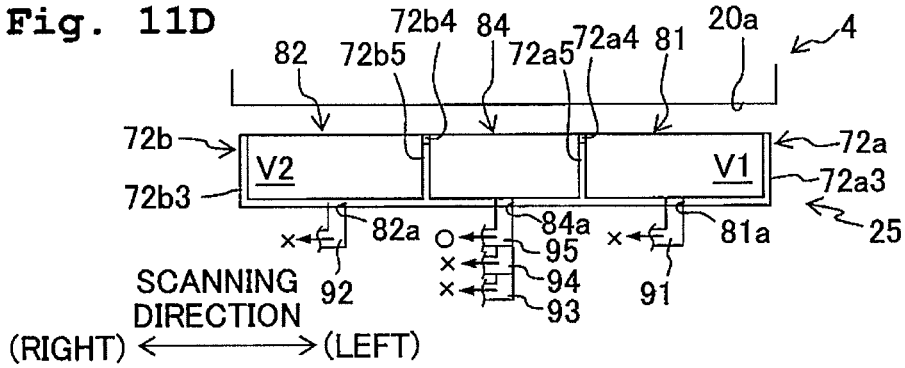

Next, a third discharge process is carried out for the color inks (S108). On this occasion, the control device 13 controls the cam drive motor 26*b* to take the separated state from the first contact state as depicted in FIG. 11D. By virtue of this, the cap 25 is separated from the jet surface 20*a* to come into an uncapping state. Thereafter, the control device 13 controls the switching portion 12 to take the third communication state, and drives the suction pump 10 in the third communication state and in the separated state at a predetermined rotary speed for a predetermined time. In so doing, the color inks inside the communicative portion 84 flow from the connective port 84*a* toward the suction pump 10 to be discharged to the waste tank 11. In this manner, the inks having undergone the periodic purge are all discharged to the waste tank 11.

Next, a wiping process is carried out (S109). On this occasion, the control device 13 raises a wiper (not depicted) with an elevating mechanism (not depicted) for raising and lowering the wiper and, thereafter, controls the carriage drive motor 14 to move the carriage 3 in the scanning direction within a predetermined range including the region overlapping with the wiper in the up-down direction. By virtue of this, with the upper end of the wiper being in contact with the jet surface 20*a*, the carriage 3 moves in the scanning direction to wipe off the inks adhering to the jet surface 20*a*.

Next, a flushing process is carried out (S110). On this occasion, the control device 13 controls the ink jet head 4 to jet the inks toward the cap 25. With that, the maintenance operation for the periodic purge is finished.

<Manual Purge>

Figure 12:
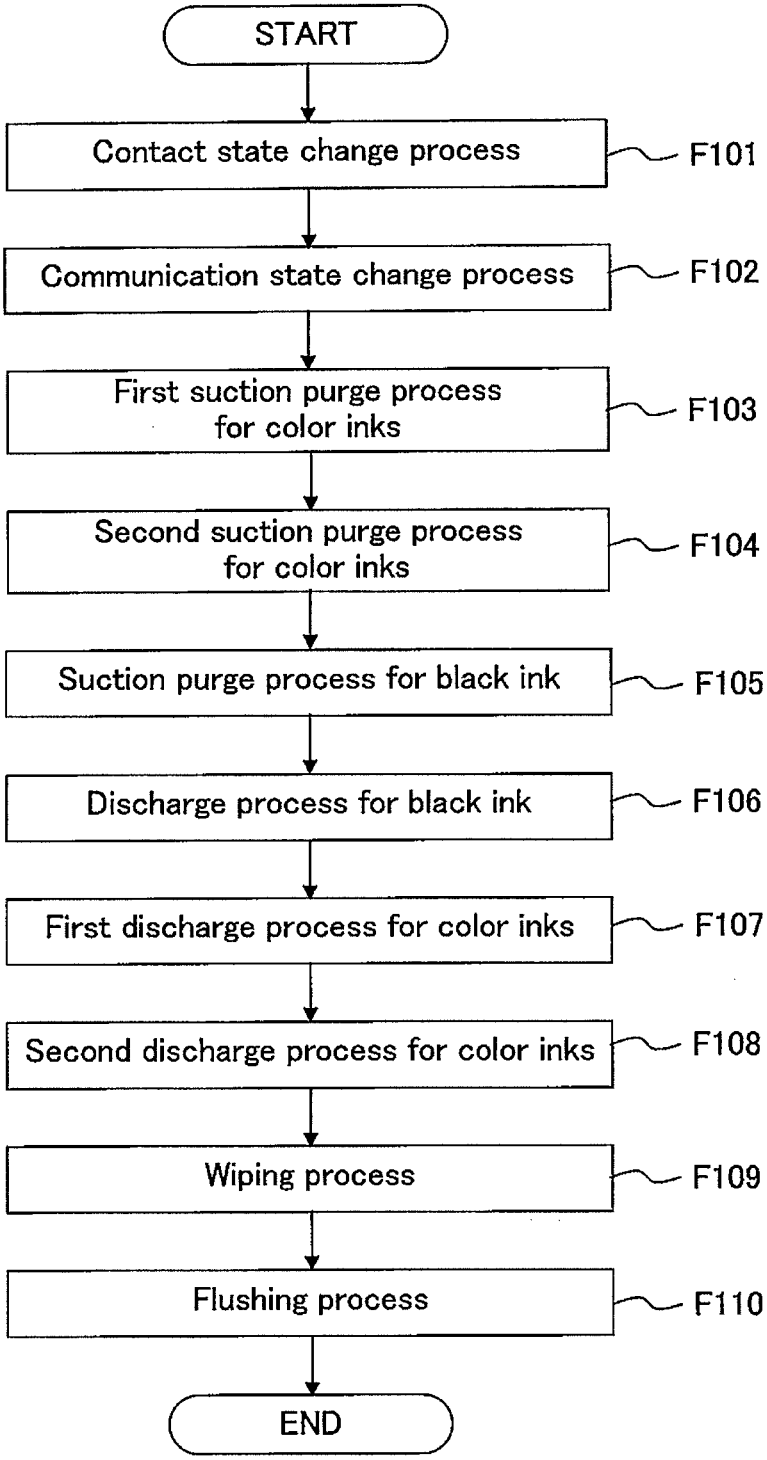
FIG. 12 is a flowchart showing a procedure of a maintenance operation for a manual purge.

In the maintenance operation of carrying out the manual purge, first, as depicted in FIG. 12, a contact state change process is carried out (step F101). On this occasion, in the same manner as in S101, the control device 13 controls the carriage drive motor 14 to let the cap 25 face the jet surface 20*a* as depicted in FIG. 8A. Thereafter, it controls the cam drive motor 26*b* to take the second contact state from the separated state as depicted in FIG. 8C, to come into the capping state. By virtue of this, the first space V1 and the second space V2 come into a state of no communication with each other through the communicative portion 84, and thus are sealed up individually from the outside. In this state, the cap portions 81 and 82 cover the six nozzle groups 48*y*1, 48*y*2, 48*c*1, 48*c*2, 48*m*1 and 48*m*2. Further, on this occasion, in the same manner as described earlier, the cap portion 83 covers the two nozzle groups 48*k*1 and 48*k*2. Further, in the following explanation, the word "step" will be omitted such that "step F101" is simply written as "F101", etc.

Next, a communication state change process is carried out (F102). On this occasion, the same process is carried out in F102 as in S102 described earlier.

Figure 13A:
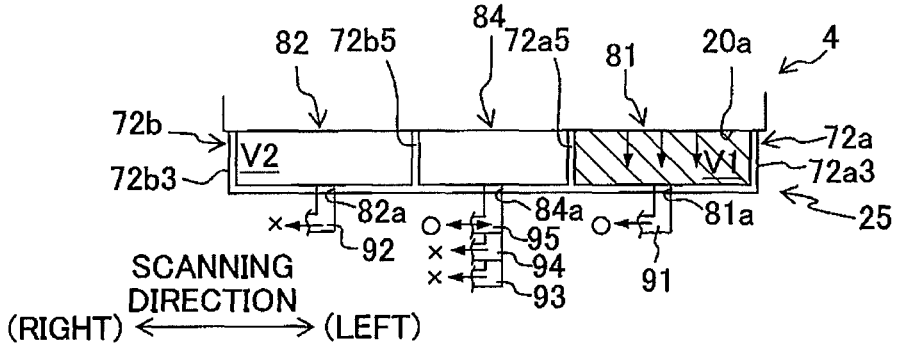

Next, a first suction purge process is carried out for the color inks (F103: the first purge process). On this occasion, the control device 13 drives the suction pump 10 in the second contact state and in the first communication state under the same condition as in S103. In so doing, the barometric pressure inside the first space V1 via the connective port 81*a* decreases to a second predetermined barometric pressure lower than the first predetermined barometric pressure. This is because the space for the suction pump 10 to suck is mainly the first space V1 alone. Therefore, more of the color inks are discharged to the cap portion 81 from the plurality of nozzles 47 belonging to the three nozzle groups 48*y*1, 48*c*1 and 48*m*1. In this manner, as depicted in FIG. 13A, the color inks are retained in the cap portion 81. Further, in proportion to the lower barometric pressure of the first space V1, a larger amount of the inks is discharged from each of the nozzles 47 than that in S103. In this manner, without changing the suction power of the suction pump 10 (rotary speed and driven time), it is still possible to render a greater suction power for the nozzles 47 in the first suction purge process than that in the periodic suction purge process. Further, while the connective port 84*a* is maintained in the first atmosphere communication state in this embodiment, it may be maintained in the first shutoff state. Even when the connective port 84*a* is in communication with the atmosphere, the communicative portion 84 is in no communication with any of the three cap portions 81 to 83 in the second contact state. Further, in FIGS. 13A to 13D, the mark "○" shows a communicable state, while the mark "x" shows a state of shutting off the communication.

Figure 13B:
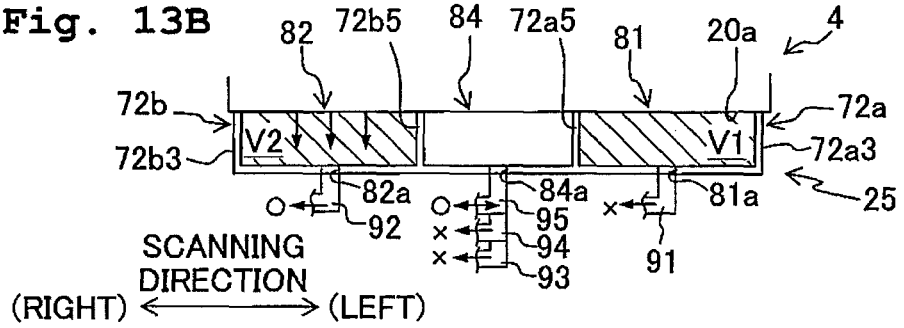

Next, a second suction purge process is carried out for the color inks (F104: the second purge process). On this occasion, the control device 13 controls the switching portion 12 to take the second communication state, and drives the suction pump 10 in the second contact state and in the second communication state for a predetermined time. In so doing, the barometric pressure inside the second space V2 via the connective port 82*a* decreases to the second predetermined barometric pressure. This is because the space for the suction pump 10 to suck is mainly the second space V2 alone. Therefore, more of the color inks are discharged to the cap portion 82 from the plurality of nozzles 47 belonging to the three nozzle groups 48*y*2, 48*c*2 and 48*m*2. In this manner, as depicted in FIG. 13B, the color inks are retained in the cap portion 82. Further, on this occasion, also in the same manner as described earlier, in proportion to the lower barometric pressure of the second space V2, a larger amount of the inks is discharged from each of the nozzles 47 than that in S103. In this manner, without changing the suction power of the suction pump 10, it is still possible to render a greater suction power for the nozzles 47 in the second suction purge process than that in the periodic suction purge process.

Next, a suction purge process is carried out for the black ink (F105). On this occasion, the control device 13 controls the switching portion 12 to take the fourth communication state, and drives the suction pump 10 in the second contact state at a predetermined rotary speed for a predetermined time. In so doing, the barometric pressure inside the third space via the connective port 83*a* decreases to a barometric pressure lower than the predetermined barometric pressure. This is because the third space in the second contact state is smaller than that in the first contact state. Therefore, more of the black ink is discharged to the cap portion 83 from the plurality of nozzles 47 belonging to the two nozzle groups 48*k*1 and 48*k*2. In this manner, the black ink is retained in the cap portion 83. Further, on this occasion, also in the same manner as described earlier, in proportion to the lower barometric pressure of the third space, a larger amount of the ink is discharged from each of the nozzles 47 than that in S104. In this manner, the amount of discharging the ink from the respective nozzles 47 is larger in the manual purge than in the periodic purge. Hence, in the manual purge, it is also possible to recover the function from the jet defection unrecoverable from in the periodic purge.

Next, a discharge process is carried out for the black ink (F106). On this occasion, the same process is carried out in F106 as in S105 described earlier. That is, the control device 13 controls the switching portion 12 to take the second atmosphere communication state, and drives the suction pump 10 in the second contact state and in the fourth communication state for a predetermined time. In so doing, the black ink inside the cap portion 83 flows from the connective port 83*a* toward the suction pump 10 to be discharged to the waste tank 11.

Figure 13C:
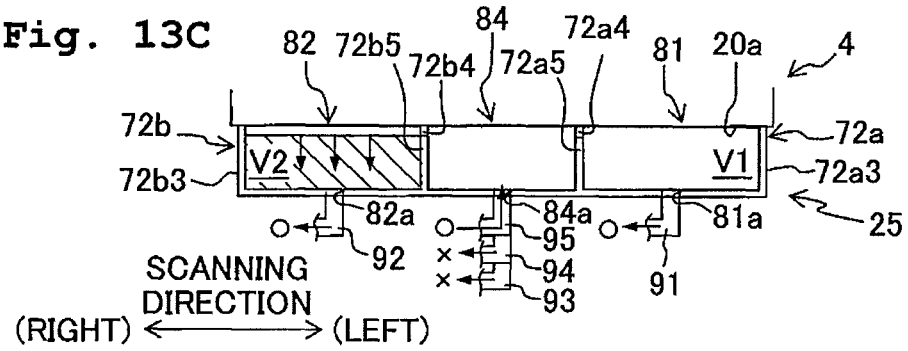

Next, a first discharge process is carried out for the color inks (F107). On this occasion, the control device 13 controls the cam drive motor 26*b* to take the first contact state. By virtue of this, the first space V1 and the second space V2 come into communication with each other through the communicative portion 84. On this occasion, the communicative portion 84 is in communication with the atmosphere via the connective port 84*a*. Then, in the same manner as in S106 described earlier, the control device 13 controls the switching portion 12 to take the first communication state, and drives the suction pump 10 in the first contact state and in the first communication state at the predetermined rotary speed for the predetermined time. In so doing, as depicted in FIG. 13C, air flows in from the connective port 84*a*, and thereby the color inks inside the cap portion 81 flow from the connective port 81*a* toward the suction pump 10 to be discharged to the waste tank 11.

Figure 13D:
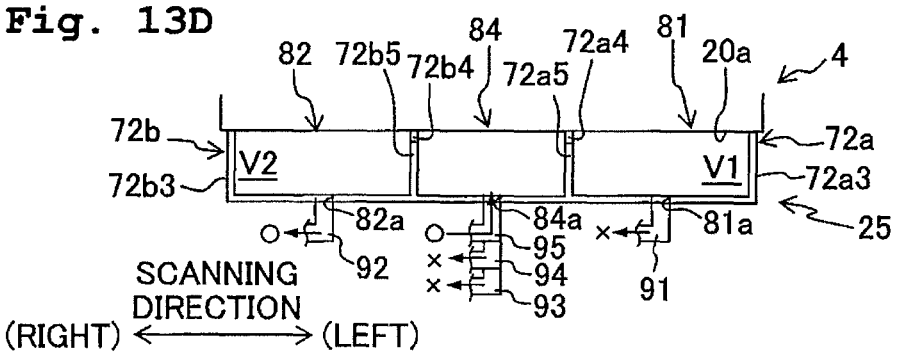

Next, a second discharge process is carried out for the color inks (F108). On this occasion, the same process is carried out in F108 as in S107 described earlier. That is, the control device 13 controls the switching portion 12 to take the second communication state, and drives the suction pump 10 in the first contact state and in the second communication state at a predetermined rotary speed for a predetermined time. In so doing, as depicted in FIG. 13D, air flows in from the connective port 84*a*, and thereby the color inks in inside the cap portion 82 flow from the connective port 82*a* toward the suction pump 10 to be discharged to the waste tank 11. In this manner, the inks having undergone the manual purge are all discharged to the waste tank 11. Further, in this embodiment, because the color inks are not retained in the communicative portion 84, the discharge process equivalent to S108 described earlier is not carried out. However, a similar discharge process may be carried out as well.

Next, a wiping process is carried out (F109). On this occasion, the control device 13 controls the cam drive motor 26*b* to take the separated state from the first contact state. Thereafter, the same process is carried out as in S109 described earlier to wipe off the inks adhering to the jet surface 20*a*. Then, the same flushing process is carried out as in S110 described earlier (F110). With that, the maintenance operation for the manual purge is finished.

As described above, according to the printer 1 in the above embodiment, in the first contact state, it is possible to cause the first space V1 and the second space V2 to communicate with each other via the communicative portion 84, whereas in the second contact state, it is possible to seal up the first space V1 and the second space V2 individually with the cap portion 81 and the cap portion 82. Therefore, in the first contact state, with the suction pump 10 sucking from the connective port 81*a* (or the connective port 82*a*), the communicative first space V1 and second space V2 come under negative pressure (at a low barometric pressure) whereby it is possible to discharge the inks simultaneously from all the nozzles 47 jetting the color inks. In the second contact state, with the suction pump 10 sucking from either the connective port 81*a* or the connective port 82*a*, it is possible to discharge the inks individually from the plurality of nozzles 47 (the first nozzles) forming the nozzle groups 48*y*1, 48*c*1 and 48*m*1, and the plurality of nozzles 47 (the second nozzles) forming the nozzle groups 48*y*2, 48*c*2 and 48*m*2. In this manner, it is possible to switch for individually or simultaneously discharging the inks from the plurality of first nozzles 47 and the plurality of second nozzles 47, by changing the contact state between the jet surface 20*a* and the cap 25. Therefore, it is possible for the suction device 9 to switch the connective ports 81*a* and 82*a* with a simple configuration.

Further, according to the printer 1 described above, it is possible to selectively carry out the first suction purge process of F103, the second suction purge process of F104, and the periodic suction purge process of S103.

Further, according to the printer 1 described above, it is possible to discharge the inks from all the nozzles 47 jetting the color inks in the periodic suction purge process of S103. In addition, it is possible to discharge the color inks retained in the respective cap portions 81 and 82 in the first discharge process (S106 and F107), and in the second discharge process (S107 and F108).

Further, according to the printer 1 described above, it is possible to discharge the inks retained in the communicative portion 84 in the periodic suction purge process of S103 and the like by carrying out the third discharge process of S108.

Further, the communicative portion 84 is arranged in a position facing the supply ports 49*k*, 49*y*1 and 49*y*2. By virtue of this, even when the cap 25 is elongated in the conveyance direction (one direction) because of the communicative portion 84 for the communication between the cap portion 81 and the cap portion 82, it is still possible to keep the printer 1 from growing in size in the conveyance direction.

Further, according to the printer 1 described above, because the cap portion 83 is provided, in the first or second contact state, with the suction pump 10 sucking from the connective port 83*a*, it is possible to discharge the inks from the plurality of nozzles 47 (the third nozzles) forming the two nozzle groups 48*k*1 and 48*k*2.

While one embodiment of the present teaching is explained above, the present teaching is not limited to the above embodiment, but can be changed in various manners. For example, in the above embodiment, the plurality of first nozzles (the plurality of nozzles 47 forming the nozzle groups 48*y*1, 48*c*1 and 48*m*1) covered by the cap portion 81 (the first cap portion) and the plurality of second nozzles (the plurality of nozzles 47 forming the nozzle groups 48*y*2, 48*c*2 and 48*m*2) covered by the cap portion 82 (the second cap portion) are in mutual communication for each color through a common channel. However, these first nozzles and second nozzles may be not in mutual communication. That is, the cap portion 82 may be configured to cover the (second) nozzles belonging to the nozzle group jetting the black ink. In such configuration, it is still possible to obtain the same effect as described above by providing the communicative portion 84.

The communicative portion 84 may be not provided with the connective port 84*a*. Further, the connective port 84*a* of the communicative portion 84 may be connected directly to the waste tank 11 via a tubing member. In such a case, it is preferable to provide a valve allowing fluid to flow only toward the waste tank 11 from the communicative portion 84 in a halfway part of the tubing member. By virtue of this, when carrying out the periodic suction purge of S103, it is possible to prevent any gaseous matter from flowing into the cap 25 and, meanwhile, it is possible to automatically discharge the inks retained in the communicative portion 84 to the waste tank 11. Further, the communicative portion 84 may not vertically overlap with the supply ports 49*k*, 49*y*1 and 49*y*2. That is, the communicative portion 84 may face an end portion of the ink jet head on the opposite side from the supply port.

The cap portion 83 may not share the lip portions with the cap portions 81 and 82 and the communicative portion 84. Further, it is possible not to provide the nozzle group jetting the black ink and the cap portion 83.

Figure 14:
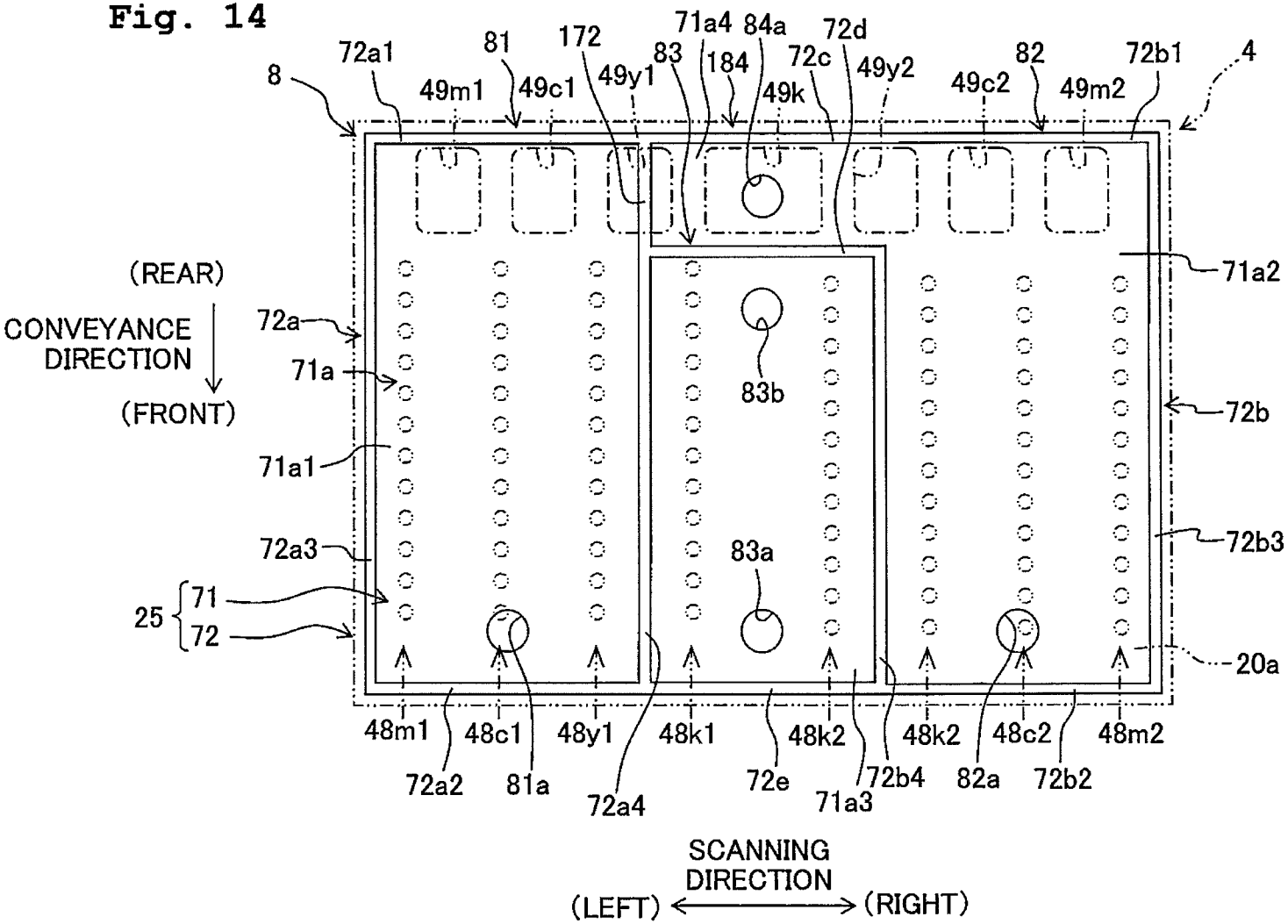
FIG. 14 is a plan view of a cap according to a modification of the embodiment.

In the above embodiment, the communicative portion 84 is enclosed by the pair of projections 72*c* and 72*d* and the extension portions 72*a*5 and 72*b*5. However, the present teaching is not limited to this. As depicted in FIG. 14, for example, a communicative portion 184 may be provided with only one projection 172 instead of the two extension portions 72*a*5 and 72*b*5. In this case, the projection 172 not only defines part of the cap portion 81 as part of the surrounding projection 72*a* but also defines part of the cap portion 82 as part of the surrounding projection 72*b*. Then, the cap portion 81 is in communication with the cap portion 82 via the projection 172. Here, the projection 172 is formed lower in height than the portions of the surrounding projections 72*a* and 72*b* of the cap portions 81 and 82 except for the projection 172. In FIG. 14, the projection 172 is formed in the same position as the extension portion 72*a*5 in the above embodiment. However, the present teaching is not necessarily limited to such a configuration. For example, the projection 172 may be formed either in the same position as that of forming the extension portion 72*b*5 in the above embodiment, or in a position between the position of forming the extension portions 72*a*5 and 72*b*5 in the above embodiment. In such cases, the cap portion 81 is in communication with the cap portion 82 via the projection 172. Further, the connective port 84*a* may be arranged either on the left side or on the right side of the projection 172. In such a configuration, in the same manner as the extension portions 72*a*5 and 72*b*5, the projection 172 is formed lower in height than the portions of the surrounding projections 72*a* and 72*b* except for the projection 172. Hence, it is possible to obtain the same effect as described earlier.

Further, the above explanation is made on examples applying the present teaching to an ink jet printer carrying out printing by jetting inks from nozzles. However, the present teaching is not limited to those examples. It is also possible to apply the present teaching to liquid discharge apparatuses other than ink jet printers jetting a liquid other than inks from nozzles. Further, the present teaching is also applicable to any types of line printers and serial printers.

What is claimed is:

1. A liquid discharge apparatus configured to discharge liquid, comprising:

a liquid discharge head having a discharge-surface in which a plurality of nozzles is formed;

a cap including an inner bottom surface facing the discharge-surface and, in contact with the discharge-surface, to cover the plurality of nozzles;

a movement mechanism configured to move at least one of the liquid discharge head and the cap to selectively take a first contact state for the cap to contact with the discharge-surface, a second contact state for the inner bottom surface of the cap to contact with the discharge-surface and to come closer to the discharge-surface than in the first contact state, and a separated state for the cap to separate from the discharge-surface; and a suction mechanism, wherein the plurality of nozzles include:

a plurality of first nozzles arrayed in one direction, and a plurality of second nozzles arrayed in the one direction and arranged in different positions from the plurality of first nozzles in an orthogonal direction orthogonal to the one direction;

wherein the cap includes:

a first cap portion configured to cover the plurality of first nozzles, the first cap portion including a first inner bottom surface facing the discharge-surface, a first surrounding projection being elastically deformable and projecting from the first inner bottom surface toward the discharge-surface, and a first connective port to be connected with the suction mechanism;

a second cap portion configured to cover the plurality of second nozzles, the second cap portion including a second inner bottom surface facing the discharge-surface, a second surrounding projection being elastically deformable and projecting from the second inner bottom surface toward the discharge-surface, and a second connective port to be connected with the suction mechanism; and a communicative portion configured to communicate the first cap portion and the second cap portion, wherein the communicative portion includes a part of the first surrounding projection of the first cap portion which is formed lower in the height from the inner bottom surface than the other portions of the first surrounding projections except the communicative portion, wherein the first cap portion is configured to seal up a first space between the first cap portion and the discharge-surface by causing the whole first surrounding projection to contact with the discharge-surface in the second contact state, wherein the second cap portion is configured to seal up a second space between the second cap portion and the discharge-surface by causing the whole second surrounding projection to contact with the discharge-surface in the second contact state, and wherein the part of the first surrounding projection of the communicative portion is separated from the discharge-surface in the first contact state, and contacts with the discharge-surface in the second contact state, and wherein the first and second cap portions and the communicative portions are configured to seal up the first and second spaces such that the first space is communicated with the second space via the communicative portion, in the first contact state.

2. The liquid discharge apparatus according to claim 1, wherein the communicative portion includes:

a first portion which is the part of the first surrounding projection of the first cap portion;

a second portion which is a part of the second surrounding projection of the second cap portion;

a third inner bottom surface connected to the first and second inner bottom surfaces and facing the discharge-surface; and a pair of elastically deformable projections projecting from the third inner bottom surface toward the discharge-surface and separating from each other while being connected with the first portion and the second portion, wherein the first and second portions are both formed lower in the height from the third inner bottom surface than the other portions of the first and second surrounding projections except the first and second portions, wherein the pair of projections are formed in a height from the third inner bottom surface same as the other portions of the first and second surrounding projections except the first and second portions, and wherein the communicative portion is configured such that in the first contact state, the pair of projections contact with the discharge-surface for the first space to communicate with the second space.

3. The liquid discharge apparatus according to claim 2, further comprising a controller configured to control the movement mechanism and the suction mechanism, wherein the suction mechanism includes a suction pump and a switching portion connected with the suction pump; the switching portion is configured to selectively take a first communication state for the suction pump to communicate with the first connective port, and a second communication state for the suction pump to communicate with the second connective port; and the controller is configured to:

control the movement mechanism to take one of the first contact state, the second contact state, and the separated state, controlling the switching portion to take any of the first communication state and the second communication state, control the suction pump in the second contact state and in the first communication state to discharge a liquid inside the liquid discharge head to the first cap portion from the plurality of first nozzles, control the suction pump in the second contact state and in the second communication state to discharge the liquid inside the liquid discharge head to the second cap portion from the plurality of second nozzles, and control the suction pump in the first contact state to discharge the liquid inside the liquid discharge head to the first and second cap portions from the plurality of nozzles.

4. The liquid discharge apparatus according to claim 3, wherein the communicative portion includes a third connective port connected with the switching portion;

wherein the switching portion is configured to further selectively take an atmosphere communication state for the third connective port to communicate with the atmosphere, and a shutoff state for the third connective port not to communicate with the atmosphere;

wherein the controller is further configured to:

control, in the first contact state and in the first communication state, the switching portion to take the atmosphere communication state_to discharge the liquid retained in the first cap portion by the suction pump, and control, in the first contact state and in the second communication state, the switching portion to take the atmosphere communication state to discharge the liquid retained in the second cap portion by the suction pump; and wherein the controller is configured to control the switching portion to take the shutoff state in discharging the liquid inside the liquid discharge head to the first and second cap portions.

5. The liquid discharge apparatus according to claim 4, wherein the switching portion is further configured to selectively take a third communication state for the third connective port to communicate with the suction pump;

wherein the controller is further configured to control the movement mechanism to take the third communication state and the separated state, and control the suction pump in the third communication state and in the separated state, so as to discharge the liquid retained in the communicative portion.

6. The liquid discharge apparatus according to claim 2, wherein the communicative portion is configured for communication between corresponding ones of end portions of the first and second cap portions in the one direction;

wherein the liquid discharge head includes a liquid supply port configured to supply a liquid; and wherein the liquid supply port is provided in one end portion of the liquid discharge head in the one direction to overlap with the communicative portion in the first and second contact states.

7. The liquid discharge apparatus according to claim 2, wherein the plurality of nozzles further include a plurality of third nozzles arrayed in the one direction, and arranged between the plurality of first nozzles and the plurality of second nozzles in the orthogonal direction;

wherein the cap further includes a third cap portion configured to cover the plurality of third nozzles, the third cap portion including a fourth inner bottom surface facing the discharge-surface, a fourth surrounding projection being elastically deformable and projecting from the fourth inner bottom surface toward the discharge-surface, and a fourth connective port to be connected with the suction mechanism;

wherein the third cap portion is configured for the whole fourth surrounding projection to contact with the discharge-surface to seal up a third space between the third cap portion and the discharge-surface in one of the first and second contact states; and wherein the communicative portion and the third cap portion are arranged between the first cap portion and the second cap portion in the orthogonal direction to deviate from each other in the one direction.

8. The liquid discharge apparatus according to claim 7, wherein the fourth surrounding projection shares parts of the first and second surrounding projections and the pair of projections.

9. The liquid discharge apparatus according to claim 2, wherein the liquid discharge head includes a plurality of first individual channels connected respectively with the plurality of first nozzles, a plurality of second individual channels connected respectively with the plurality of second nozzles, and a common channel connected to the plurality of first and second individual channels.

* * * * *